US011535802B2

(12) United States Patent
Shuey et al.

(10) Patent No.: US 11,535,802 B2
(45) Date of Patent: Dec. 27, 2022

(54) SULFUR REDUCTION METHODS AND SYSTEMS

(71) Applicant: Santa Fe Resources Development, Inc., Dallas, TX (US)

(72) Inventors: Robert A. Shuey, Dallas, TX (US); Stephen J. Gorton, Dallas, TX (US); Robert L. Cargill, Dallas, TX (US)

(73) Assignee: Santa Fe Resources Development, Inc., Dallas, TX (US)

( * ) Notice: Subject to any disclaimer, the term of this patent is extended or adjusted under 35 U.S.C. 154(b) by 0 days.

(21) Appl. No.: 17/405,729

(22) Filed: Aug. 18, 2021

(65) Prior Publication Data

US 2022/0056347 A1 Feb. 24, 2022

Related U.S. Application Data

(60) Provisional application No. 63/067,614, filed on Aug. 19, 2020.

(51) Int. Cl.

| | |
|---|---|
| ***C10G 53/10*** | (2006.01) |
| ***C10G 53/12*** | (2006.01) |
| ***C10G 45/02*** | (2006.01) |

(52) U.S. Cl.
CPC ..... *C10G 45/02* (2013.01); *C10G 53/10* (2013.01); *C10G 53/12* (2013.01); *C10G 2300/202* (2013.01)

(58) Field of Classification Search
CPC ..... C10G 53/02; C10G 53/10; C10G 53/12
See application file for complete search history.

(56) References Cited

U.S. PATENT DOCUMENTS

2015/0005522 A1* 1/2015 Lupton ..... C11B 3/04 554/175
2015/0094482 A1* 4/2015 Lupton ..... C11B 3/04 554/188

* cited by examiner

*Primary Examiner* — Randy Boyer
*Assistant Examiner* — Juan C Valencia
(74) *Attorney, Agent, or Firm* — Fox Rothschild LLP

(57) ABSTRACT

Methods and systems for reducing sulfur content in crude oil are provided. The methods and systems apply a first alkaline aqueous solution to crude oil to produce alkaline-treated crude oil, apply an acid aqueous solution to the alkaline-treated crude oil to produce acid-treated crude oil, apply a second alkaline aqueous solution to the acid-treated crude oil to produce neutralized crude oil; and separate residual water that contains sulfur from the neutralized crude oil to produce treated crude oil that has less sulfur content than the crude oil before the treatment.

20 Claims, 16 Drawing Sheets

SULFUR REDUCTION METHODS AND SYSTEMS

CROSS-REFERENCE TO RELATED APPLICATION

This application claims the benefit of priority to U.S. Provisional Patent Application No. 63/067,614, filed Aug. 19, 2020, which is incorporated by reference herein in its entirety.

TECHNICAL FIELD

The present disclosure generally relates to methods and systems for reducing sulfur content in crude oil or for desulfurization of crude oil. In particular, the present disclosure relates to methods and systems for reducing sulfur content in crude oil or desulfurization of crude oil using a metal ion catalyst.

BACKGROUND

Up to ninety percent of crude oil in the world is heavy crude that is high in sulfur. In general, sulfur content in heavy crude ranges from 2 percent to above 4 percent by weight. This type of crude containing a high amount of sulfur impurity is often referred to as a "sour crude." Sour crude is considered less desirable than "sweet crude," which contains relatively lower sulfur content. Sulfur is considered an undesirable contaminant because it generates sulfur oxides ($SO_x$) when burned. The resulting sulfur oxides are environmentally undesirable and have been found to have a long-term deactivation impact on automotive catalytic converters, which are used to remove nitrogen oxide and unburned hydrocarbon contaminants from automotive emissions. High levels of sulfur in crude oil are corrosive and cause major damage to pipelines, storage tanks, and refinery systems. This makes sulfur removal a critical part of the overall crude oil refinement process. Sulfur is also known to harm some catalysts used in the refining process so it can be removed at some point from intermediate streams before they can be fed to a conversion unit. Furthermore, crude oil grade with high sulfur content generally has a lower commercial value because it has undesirable effects on the finished petroleum products.

There are some well-known methods for removing the sulfur from heavy crude oil during processing. A process known as "thermal cracking" can crack hydrocarbon molecules that contain sulfur and remove sulfur as hydrogen sulfide ($H_2S$) gas. Sulfur can also be removed directly by processing a hydrocarbon stream through a process called "hydrotreating," where the sulfur in the hydrocarbon is replaced with a hydrogen atom, and the released sulfur is combined with a free hydrogen molecule to form $H_2S$ gas, which is then removed. A drawback to sulfur removal using the hydrotreating process is that hydrogen sulfide ($H_2S$) gas creates an offensive and unpleasant "rotten egg" odor. Exposure to high levels of hydrogen sulfide ($H_2S$) can also be life-threatening. Another drawback is that the thermal cracking and hydrotreating processes require external heat energy, which renders the process economically less efficient.

SUMMARY

The subject disclosure is related to a method of reducing sulfur content in crude oil. A first alkaline aqueous solution is applied to crude oil, and in response, a resulting alkaline treated crude oil having an aqueous solution pH higher than 7.0 is produced. An acid aqueous solution is then applied to the alkaline-treated crude oil, and in response, a resulting acid-treated crude oil having an aqueous solution pH lower than 7.0 is produced. A second alkaline aqueous solution is then applied, and in response, a resulting neutralized crude oil having an aqueous solution pH about 7.0 is produced. Residual water that contains sulfur is then separated from the neutralized crude oil, and in response, treated crude oil is produced. At least one of the first alkaline aqueous solution, the acid aqueous solution, or the second alkaline aqueous solution comprises a metal ion catalyst. The treated crude oil (resulting from the process) contains less (e.g., significantly less) sulfur content than the crude oil (e.g., the treated crude oil is substantially absent sulfur content such having less than, for example, about 1 percent, about 1.5 percent, or about 2 percent by weight, and reduced from, for example, about 3 percent, about 3.5 percent, or about 4 percent. Sulfur content in treated crude oil is reduced by, for example, about 40 percent, about 50 percent, about 60 percent, or about 70 percent, as compared to untreated crude oil.)

In some desired examples, the method further comprises recovering and recycling at least one of the first alkaline aqueous solution, the acid aqueous solution, and the second alkaline aqueous solution. In certain examples, the method further comprises supplying compressed air to a location where the alkaline-treated crude oil, the acid-treated crude oil and the neutralized crude oil are produced. The method further comprises, in certain examples, supplying metal ions to a location where at least one of the alkaline-treated crude oil, the acid-treated crude oil and the neutralized crude oil is being formed.

In some examples, the method further comprises providing at least one alkaline processing container configured to receive the crude oil and the first alkaline aqueous solution and deliver the alkaline-treated crude oil; providing at least one acid processing container configured to receive the alkaline-treated crude oil and the acid aqueous solution and deliver the acid-treated crude oil; providing at least one neutralization container configured to receive the acid-treated crude oil and the second alkaline aqueous solution and deliver the neutralized crude oil; and providing at least one separation container configured to receive the neutralized crude oil from the neutralization container, separate residual water that contains sulfur from the neutralized crude oil, and deliver the treated crude oil.

The subject disclosure is also related to a system comprising an alkaline processing station, an acid processing station, a neutralization station, and a separation station. The alkaline processing station comprises at least one alkaline processing container configured to receive crude oil comprising sulfur content, and first alkaline aqueous solution and deliver alkaline-treated crude oil having an aqueous solution pH higher than 7.0. The acid processing station comprises at least one acid processing container configured to receive the alkaline-treated crude oil and acid aqueous solution and deliver acid-treated crude oil having an aqueous solution pH lower than 7.0. The neutralization station comprises at least one neutralization container configured to receive the acid-treated crude oil and second alkaline aqueous solution and deliver neutralized crude oil having an aqueous solution pH about 7.0. The separation station comprises at least one separation container configured to receive the neutralized crude oil, separate residual water that contains sulfur from the neutralized crude oil and deliver treated crude oil. At least one of the first alkaline aqueous solution, the acid aqueous solution, and the second alkaline aqueous solution comprises a metal ion catalyst. The treated crude oil contains less sulfur content than the crude oil.

In some examples, the system further comprises an alkaline solution tank that supplies the first alkaline aqueous solution to the alkaline processing container; and an acid solution tank that supplies the acid aqueous solution to the acid processing container. Similarly, the system further comprises an alkaline solution tank that supplies the second alkaline aqueous solution to the neutralization container.

Also, the system may further comprise an alkaline solution and a metal catalyst recovery tank that recovers the first alkaline aqueous solution from and recycles back to the alkaline processing container; an acid solution and a metal catalyst recovery tank that recovers the acid aqueous solution from and recycles it back to the acid processing container; and an alkaline solution and a metal catalyst recovery tank that recovers the second alkaline aqueous solution from and recycles it back to the neutralization container.

In some desired examples, the system further comprises an aeration system that supplies compressed air to at least one of the alkaline processing containers the acid processing container, and the neutralization container.

In certain examples, at least one alkaline processing containers comprises more than one alkaline processing container arranged in series. A first alkaline processing container receives the crude oil and the first alkaline aqueous solution, produces the alkaline-treated crude oil, and communicates the alkaline-treated crude oil to a last alkaline processing container. The last alkaline processing container delivers the alkaline-treated crude oil.

Similarly, in some examples, at least one acid processing container comprises more than one acid processing container arranged in series. A first acid processing container receives the alkaline-treated crude oil and the acid aqueous solution, produces the acid-treated crude oil, and communicates the acid-treated crude oil to a last acid processing container. The last acid processing container delivers the acid-treated crude oil.

Similarly, in some examples, at least one neutralization container comprises more than one neutralization container arranged in series. A first neutralization container receives the acid-treated crude oil and the second alkaline aqueous solution, produces the neutralized crude oil, and communicates the neutralized crude oil to a last neutralization container. The last neutralization container delivers the neutralized crude oil.

Similarly, in some examples, at least one separation container comprises more than one separation container arranged in series. A first separation container receives the neutralized crude oil, produces a treated crude oil, and communicates the treated crude oil to a last separation container. The last separation container delivers the treated crude oil.

Also, at least one of the alkaline processing container(s), the acid processing container(s), and the neutralization container(s) may comprise a metal ion generation system that comprises at least one perforated copper tube filled with one or more transition metals.

BRIEF DESCRIPTION OF THE DRAWINGS

Various features of examples and examples in accordance with the principles described herein may be more readily understood with reference to the following detailed description taken in conjunction with the accompanying drawings, where like reference numerals designate like structural elements, and in which.

DETAILED DESCRIPTION

Figure 1:
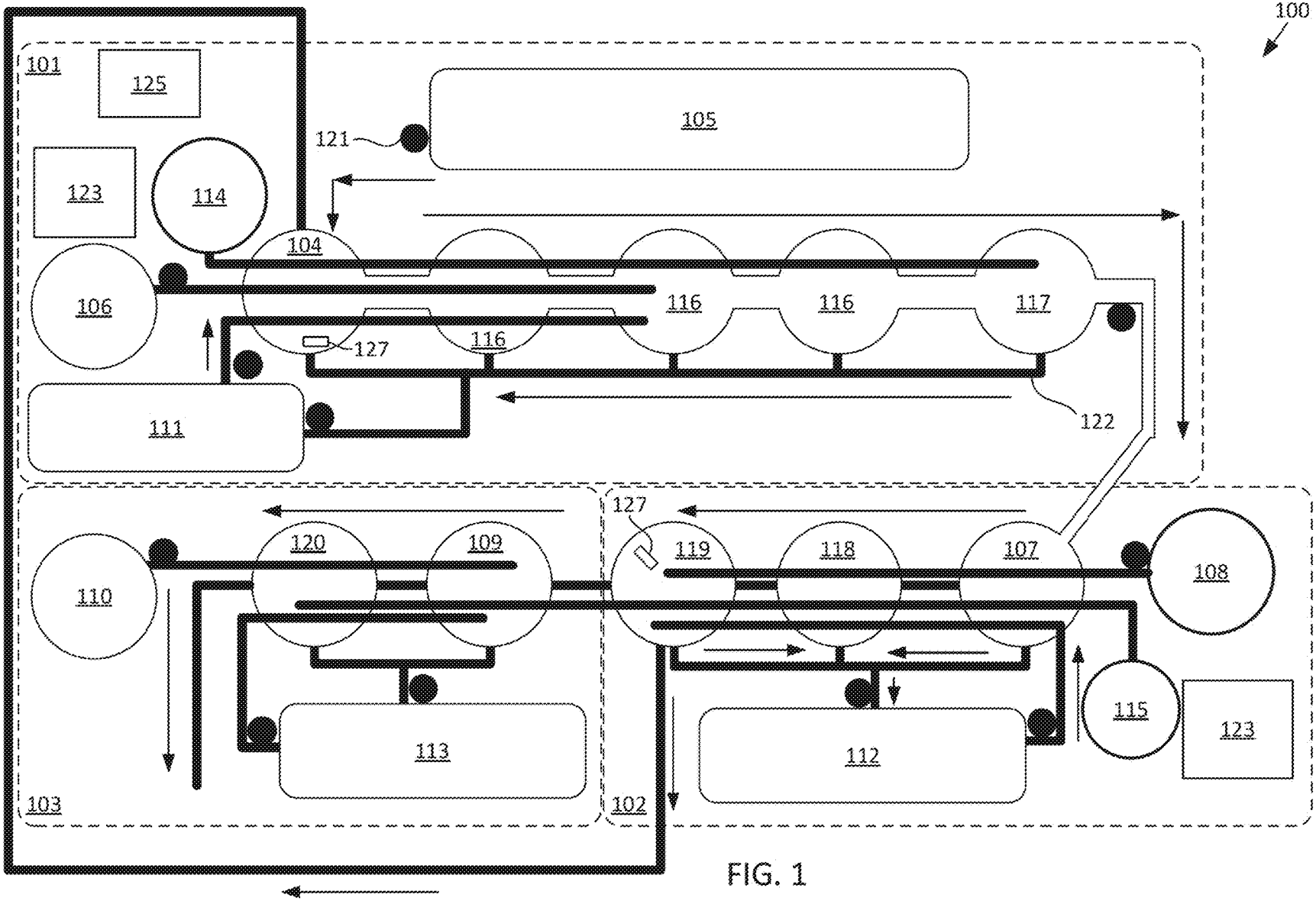
FIG. 1 is a schematic diagram of a system designed to reduce and remove sulfur content in crude oil, according to an example of the present disclosure.

Further in relation to this, it is to be understood that the disclosure is not limited in its application to the details of construction and to the arrangements of the components set forth in the following description. It would be understood by those of ordinary skill in the art that examples beyond those described herein are contemplated, and the examples can be practiced and carried out in a plurality of different ways. Also, it is to be understood that the terminology used herein is for the purpose of description and should not be regarded as a limiting factor.

Unless otherwise defined, the terms used herein refer to that which the ordinary artisan would understand such term to mean based on the contextual use of such term herein. To the extent that the meaning of a term used herein as understood by the ordinary artisan based on the contextual use of such term differs in any way from any particular dictionary definition of such term, it is intended that the meaning of the term as understood by the ordinary artisan will prevail.

As used herein, the term "about" is equal to a particular value plus or minus 10 percent (+/−10%).

As used herein, the term "crude oil" (unless the term is qualified such as, treated crude oil) has the plain meaning understood by those of ordinary skill in the art in the current field of technology, which would be understood not to be limited to raw crude oil directly from the well. For example, the term "crude oil" includes oil from the well, unprocessed crude oil, or extracted oil before significant processing to refine or convert the oil to a petroleum product. Also, for example, the term "crude oil" herein may refer to any at least partially refined petroleum extracted from a geological formation.

As used herein, the term "deliver" and "delivery" refer to the act of allowing the transport of materials to a specific location in a passive or active fashion.

As used herein, the term "desulfurization" is a chemical process for the reduction or removal of sulfur from a material. This chemical process described includes the use of metals and metal ion and metal catalysts.

As used herein, the term "in series" means that two or more containers are placed along a flow line such that a fluid stream from one container to the next one can be in a substantially constant downstream direction.

As used herein, when a crude oil has an aqueous solution pH with a specific value, it means that within the crude oil, there is an aqueous solution having a pH with a specific value.

The sulfur-reducing or desulfurization technology described in the present application is unique and different than other metal catalyst technologies in numerous aspects. The technology comprises a four-phase sequential processing of high-sulfur containing crude oil using a metal ion catalyst: Phase 1 (alkaline phase); Phase 2 (acid phase); Phase 3 (neutralization phase); and Phase 4 (separation phase). To be specific, the technology is directed to a chemical delivery application and a process used to drop a portion of sulfur content out of crude oil into a water phase. During Phase 1 (alkaline phase), Phase 2 (acid phase), and Phase 3 (neutralization phase), at least some of the sulfur content in the water-oil mixture is transferred from an oil phase to a water phase. Further, a chemical reaction occurs between the water phase and the oil phase.

During the chemical reaction, some of the chemical bonds between the hydrocarbon chains (carbon atoms) and sulfur bonds are catalytically split and rebound to metal ions to form a sulfur salt as a result of a chemical precipitation reaction, an exothermic catalytic reaction in the presence of metal ions. Most of the sulfur in crude oil is bonded to carbon atoms. During the Acid/Base chemical reaction, heat, hydrogen and oxygen gas are generated in the chemical reactions in Phase 1, Phase 2, and Phase 3. The bonding between sulfur and metal ions is formed through the ionic bonding of salt metals.

A precipitation reaction or base/acid/base described herein, is a base/acid/base displacement reaction, in which a metathesis reaction occurs in the ionic aqueous solution. In the presence of metal ions in the aqueous solution (alkaline aqueous solution and acid aqueous solution), the acid base reaction herein occurs where two or more compounds exchange anion-cation partners to form two new products by interchanging their ions or radicals, also known as a double decomposition reaction or double displacement reaction. The sulfur salts are generally higher in density, heavier-weight molecules as compared to crude oil. The sulfur salts are separated and "sink" to the water phase in the form of potassium sulfate (e.g. $2K^{+}SO_4^{2-}$), sodium sulfate, zinc sulfate, iron sulfate, copper sulfate, magnesium sulfate, manganese sulfate, aluminum sulfate, lithium sulfate, or mixtures thereof. The chemical reaction for the process described is a precipitation reaction (Base→Acid→Base) or displacement reaction.

In disclosure of the present example, the sequence of chemical processes is described herein, whereas the alkaline aqueous phase (Phase 1) of crude oil processing precedes the acid aqueous phase (Phase 2) to be more effective and efficient and effective at producing sulfur bond separation and precipitation in crude oil.

The chemical process sequence of starting in an alkaline phase (base) followed by an acid phase (acid) followed by an alkaline neutralization phase (base) is another unique aspect and different than other examples of inventions.

By following the described chemical process order (sequence), the precipitation of sulfur and other contaminants in crude oil occurs. The precipitation or "double displacement reaction" or displacement of sulfur in a hydrocarbon (Carbon atom) chain has been improved with the addition of metal ions included in each of the aqueous phases (alkaline aqueous phase, acid aqueous phase, neutralization phase) to lead to ionic bonding of potassium (cation) to sulfur (anion) to produce potassium sulfate, or zinc (cation) to sulfur (anion) to produce zinc sulfate, or iron (cation) to sulfur (anion) to produce iron sulfate, which occurs in the aqueous phase (water column).

Debris in the oil such as shale or dirt are also removed during the separation phase and also sink to the water phase. A portion of the sulfur content removed from the heavy crude oil can be recovered in Phase 4 (separation phase) along with the metal ion catalyst in the water phase. The metal ion catalyst can be collected from the water phase and reused in Phase 1 (alkaline phase); Phase 2 (acid phase); and Phase 3 (neutralization phase), which makes the entire process economically more efficient. Another distinct advantage of this technology is that it requires no external heat energy in the chemical reaction to reduce sulfur from crude oil. External heat energy to some extent could be involved if desired but it is not required. This technology also allows a user operator to save operating costs and improve efficiencies by automation of the entire process and maintaining a tighter control over operations parameters and over the input resource use.

Activation of the catalyst during each phase, in certain examples, is achieved by controlling and adjusting other established operating parameters. An exothermic reaction occurs at established set points (parameter ranges), which causes a reaction between the metal ion, a metal catalyst, the alkaline solution, the acid solution and the sulfur "sulfur carbon bond" in the crude oil. The chemical reaction is an exothermic REDOX BASE chemical reaction in Phase1 (Alkaline phase). In certain examples, the alkaline phase precedes the acid phase to produce increased volumetric expansion and separation in the crude oil. In certain examples, where the acid phase precedes the alkaline phase, removal or reduction of sulfur and other materials such as shale, sand, debris, and other inert materials from the crude oil may be marginal. This is primarily due to the volumetric expansion of the crude oil in the alkaline aqueous phase and the initial bonding split between sulfur and carbon atoms occurring prior to the acid phase.

The present application is directed to a technology specifically used to reduce sulfur content in crude oil by, for example, but not limited to, a sulfur reduction of 45 percent up to 75 percent; or by a sulfur reduction of 50 percent up to 65 percent, prior to the crude oil refining process.

For example, crude oil with 4 percent sulfur by weight that is reduced to 2 percent sulfur by weight constitutes a 50 percent reduction in sulfur in treated crude oil. Crude oil with 3 percent sulfur reduced to 1.5 percent sulfur constitutes a 50 percent reduction in sulfur.

The application of this technology can be found, for example, in the field at tank storage facilities receiving crude oil or at a pipeline which transports crude oil. Beneficially, this technology of the subject disclosure may be used at any desired or suitable point of refining process.

Also included in this subject disclosure is a designed and engineered chemical delivery system and a sequential process flow system used to move crude oil in the process phases from the first to the last phase. The metal catalysts can be recovered in Phase 4 (Separation phase), whereby the crude oil (oil phase) and a water phase are separated from the water-oil mixture. The recovered metal catalysts can be reused during each phase of processing crude oil.

Figure 2:
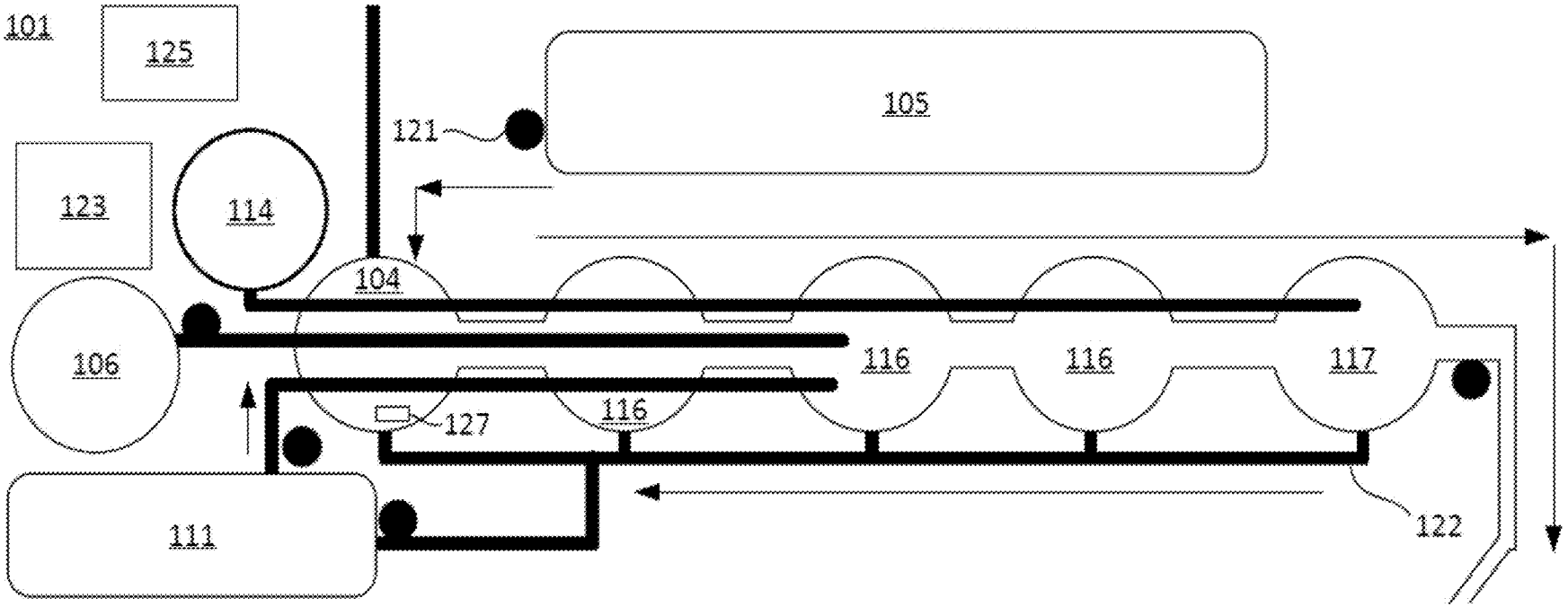
FIG. 2 is a schematic diagram of an alkaline processing station.

In FIG. 1, a system 100 designed to reduce and remove a portion of sulfur content in crude oil comprises an alkaline processing station 101, an acid processing station 102, a neutralization station 103, and a separation station (not shown). As also shown in FIG. 2, the alkaline processing station 101 comprises more than one alkaline processing container (e.g., column or tank) 104, 116, 117 arranged in series and configured to receive crude oil having sulfur content from crude oil source 105 (e.g., tank, container or pipeline), and first alkaline aqueous solution from an alkaline solution tank 106, and subsequently deliver alkaline-treated crude oil. In other examples, one alkaline processing container is used.

The first alkaline aqueous solution is produced, in certain examples, by pre-mixing a strong base such as hydroxide potassium and metal ion catalysts in water. Alternatively, sodium hydroxide can be used. Potassium hydroxide, beneficially, is useful because the effluent or wastewater including potassium, metals, and water can be reused in possible agriculture applications to grow vegetation and crops. Sodium hydroxide, in some examples, may add too high a level of sodium to grow crops and vegetation. In general, the alkaline-treated crude oil has a pH higher than about 8.0. In a particular case, the pH can be between about 10 and 14. Alternatively, the alkaline-treated crude oil has an aqueous solution pH than about 7.0, 7.5, 8.0, 8.5, 9.0, 9.5, 10.0, 10.5, 11.0, 11.5, 12.0, 12.5, 13.0, 13.5 or 14.0.

In the alkaline state, the alkaline-treated crude oil increases in volume up to about 20% primarily due to the exothermic reaction and the generation of oxygen and hydrogen gas, and this volumetric expansion allows the alkaline chemical substances to contuse and break the weaker bonds between the hydrocarbon chains, specifically the carbon atoms and sulfur bonds. The sulfur bonds are separated from the hydrocarbon chains and are released into the first alkaline aqueous solution. FIG. 1 shows an exemplary example involving five alkaline processing containers 104, 116, 117. A first alkaline processing container 104 receives the crude oil and the first alkaline aqueous solution from alkaline solution tank 106 to produce the alkaline-treated crude oil, and, after a period of time (e.g., 20-70 minutes), communicates (e.g., via piping and inlet/outlet ports) the alkaline-treated crude oil to a next sequential alkaline processing container 116, 117 configured to receive the first alkaline aqueous solution. The number of alkaline processing containers, however, is not limited to five but rather can be any reasonable number, for example, but not limited to, between 1 and 20. The first alkaline aqueous solution comprises a metal ion catalyst. The metal ion catalyst includes, but is not limited to, iron, zinc, copper, potassium permanganate, manganese, potassium, sodium, magnesium, aluminum, lithium, or a mixture thereof. In certain examples, the mixture of metal ion catalysts includes a mixture of dissimilar metal ion catalysts.

A strong exothermic acid/base chemical reaction is created when an acid solution (e. g., pH about 1 or 2) is added to the alkaline treated crude oil in the presence of a two or more metals or metal catalysts (e.g., iron and copper, or zinc and copper, or manganese and copper). The generated heat, oxygen, and produced hydrogen gas continues to expand the crude oil and separate the sulfur from the acid-treated crude oil and releases additional contaminants into the water column (aqueous layer).

Figure 3:
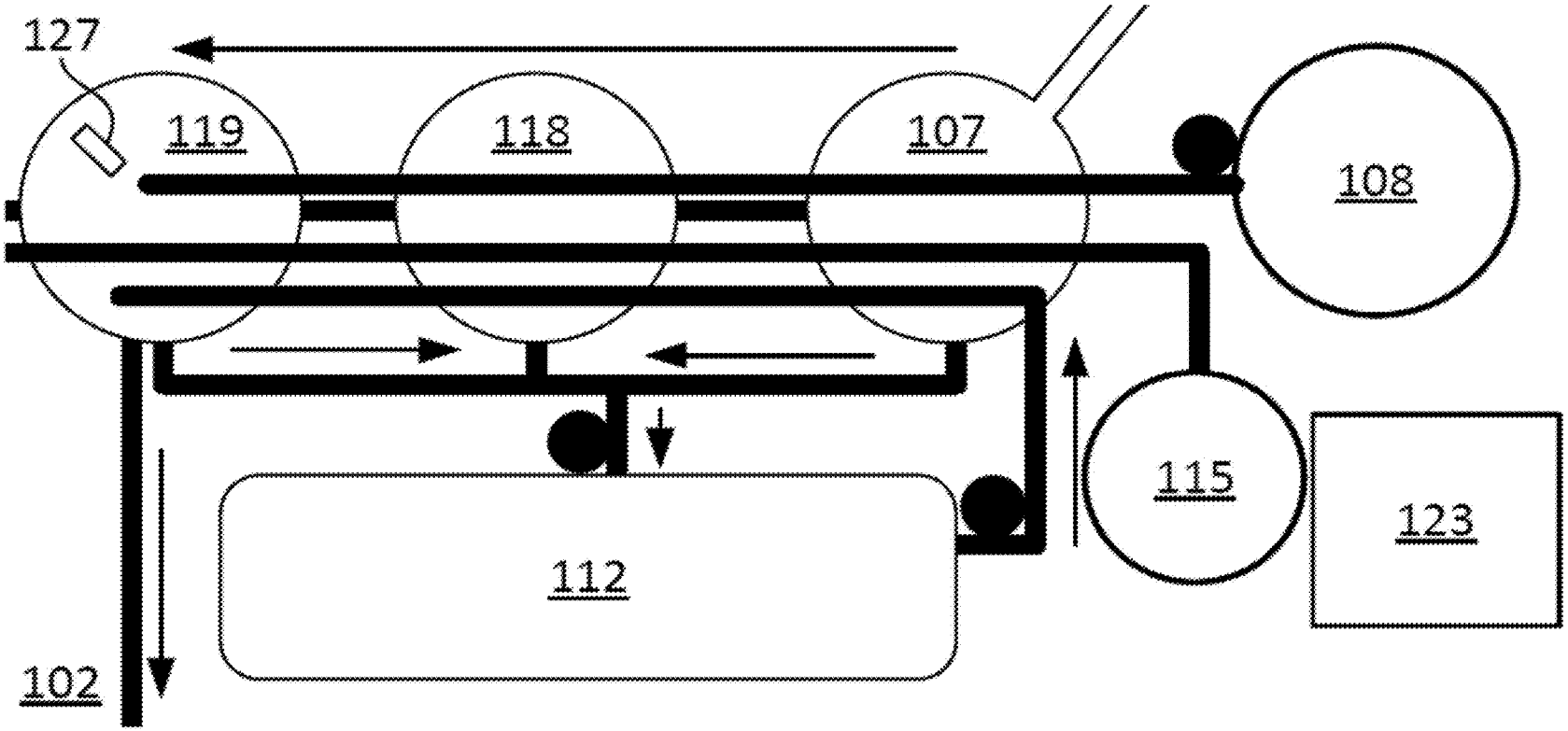
FIG. 3 is a schematic diagram of an acid processing station.

In FIG. 1, the system 100 further comprises an acid processing station 102. As also shown in FIG. 3, the acid processing station 102 comprises one or more acid processing containers (e.g., column or tank) 107, 118, 119 arranged in series and configured to receive the alkaline-treated crude oil from the alkaline processing container 117, and acid aqueous solution from an acid solution tank 108, and deliver acid-treated crude oil. In other examples, one acid processing container is used. The acid aqueous solution may be produced by pre-mixing a strong acid (e.g., phosphoric acid) and metal ion catalysts in water such that the acid-treated crude oil has a pH less than about 3.0 in the water phase. In a particular case, the acidic condition has a pH of about 1.0 to 2.0. Alternatively, the acid-treated crude oil has an aqueous solution pH lower than about 7.0, 6.5, 6.0, 5.5, 5.0, 4.5, 4.0, 3.5, 3.0, 2.5, 2.0, 1.5, and 1.0.

The acidic condition contracts the acid-treated crude oil and settles out a portion of the sulfur plus inert minerals, shale, metals, and other inert materials only after the catalytic chemical reaction in Phase 1 (alkaline phase) is complete. During Phase 2 (acid phase), the acid-treated crude oil contracts following a second exothermic reaction that occurs when the acids react with the aqueous metal catalysts and other alkaline materials in the solution when there is a substantial and dramatic pH drop, for example, but not limited to, below pH 3.5 or 3.0. A strong exothermic reaction is created when an acidic solution (e.g., between about pH 1.0 and 2.0) is added to the alkaline-treated crude oil 107, 118, 119.

The generated heat continues to separate the sulfur from carbon (carbon atoms) in the acid-treated crude oil and releases additional contaminants. During the exothermic reaction, shale, minerals, sulfur, salts, and other inert materials which are molecularly denser and heavier than the acid-treated crude oil settle "drop out" from the acid-treated crude oil (top layer) into the water column (bottom layer). By removal of the heavier, denser molecules (denser molecules) and inert materials, the acid-treated crude oil in Phase 2 (acid phase) becomes lighter, (less dense), has a higher API (American Petroleum Institute) value and contains less sulfur. API value is related to specific gravity. Specific gravity is a measurement of relative density of a liquid or fluid at 60 F. If a fluid or liquid has a relative density value greater than 1, it sinks. If the fluid or liquid has a relative density less than 1 it floats. By binding up sulfur with metal ions to form salts, the molecules become denser and have a relative density greater than one and sink into the water column.

The acid aqueous solution comprises a metal ion catalyst. The metal ion catalyst may include, but is not limited to, iron, zinc, copper, potassium permanganate, manganese, potassium, sodium, magnesium, aluminum, lithium, or a mixture thereof.

FIG. 1 shows an exemplary example where three acid processing containers are placed. A first acid processing container 107 receives the alkaline-treated crude oil and the acid aqueous solution to produce the acid-treated crude oil, and, after a period of time (e.g., 20-70 minutes), communicates the acid-treated crude oil to a next sequential acid processing container 118, 119 configured to receive the acid aqueous solution. A last acid processing container 119 delivers the acid-treated crude oil to the neutralization processing container 109. The number of acid processing containers, however, is not limited to five but rather can be any number, for example, between 1 and 20. The acid aqueous solution comprises a metal ion catalyst. In certain examples, the metal ion catalyst includes, but is not limited to, iron, zinc, copper, potassium permanganate, manganese, potassium, sodium, magnesium, aluminum, lithium, or a mixture thereof.

The acid aqueous solution comprises a metal ion catalyst, or two or more dissimilar metals (iron and copper, zinc and copper, iron, and zinc). Metal ion catalysts include, but are not limited to transition metals such as iron, zinc, copper, potassium, potassium permanganate, magnesium, manganese, aluminum, lithium, or a mixture thereof. An Acid-Base precipitation reaction in which two or more metals or metal ions are present allows a displacement or double displacement reaction to take place; and thus, achieves the re-bonding of sulfur-salts in the water column.

In some examples, the ratio among the number of alkaline processing containers, acid processing containers and neutralizing containers is about 5:3:2. The ratio, however, is not an absolute one and can be modified (e.g., (4) alkaline processing containers, (3) acid processing containers, (2) neutralization containers; or (5) alkaline processing containers, (2) acid processing containers, (2) neutralization containers).

Figure 4:
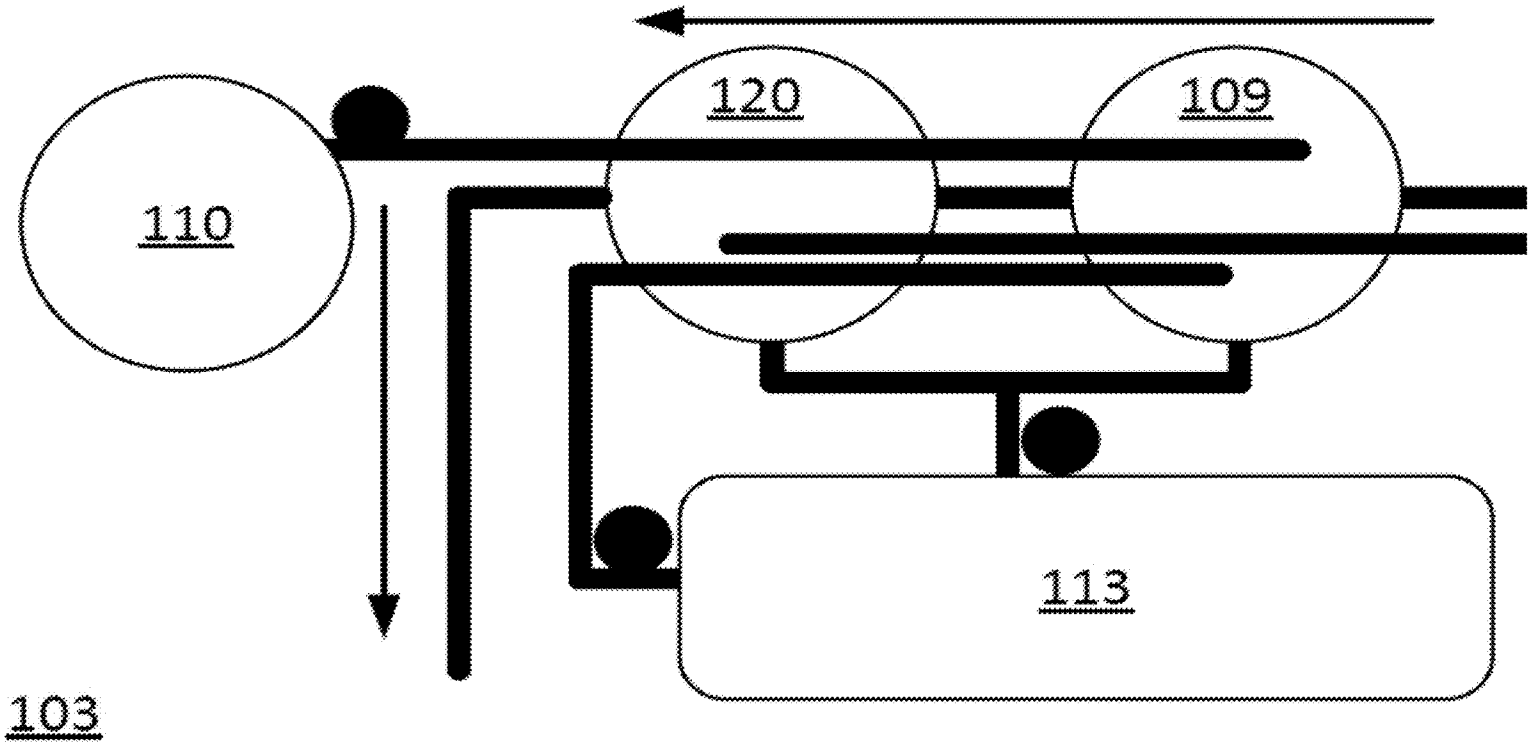
FIG. 4 is a schematic diagram of a neutralization station.

The system 100 further comprises a neutralization station 103, as shown in FIG. 4. The neutralization station 103 comprises one or more neutralization containers (e.g., column or tank) 109, 120 arranged in series and configured to receive the acid-treated crude oil from the last in the series acid processing container 119 and second alkaline aqueous solution from an alkaline solution tank 110, and deliver neutralized crude oil. In other examples, one neutralization container is used. The second alkaline aqueous solution is produced by pre-mixing a strong base such as potassium hydroxide and the metal ion catalysts in water. Alternatively, sodium hydroxide may be used. In general, the neutralized crude oil has an aqueous solution pH of about 7.0.

FIG. 1 shows an exemplary example where two neutralization containers are placed. A first neutralization processing container 109 receives the acid-treated crude oil from acid processing container 119 and the second alkaline aqueous solution, tank 110, to produce the neutralized crude oil, and, after a period of time (e.g., 20 minutes), communicates the neutralized crude oil to a next sequential neutralization container 120 configured to receive the second alkaline aqueous solution. The last neutralization container 120 delivers the neutralized crude oil. The number of neutralization processing containers, however, is not limited to two or five but rather can be any reasonable number, for example, between 1 and 20. The second alkaline aqueous solution comprises a metal ion catalyst. In certain examples, the metal ion catalyst includes, but is not limited to, iron, zinc, copper, potassium permanganate, manganese, potassium, sodium, magnesium, aluminum, lithium, or a mixture thereof. The mixture, in certain examples, includes dissimilar metal ion catalysts.

The system 100 further comprises a separation station (not shown). The separation station comprises at least one separation container (e.g., column or tank) configured to receive the neutralized crude oil, to separate residual water that contains sulfur from the neutralized crude oil, and to deliver treated crude oil. A first separation container receives the neutralized crude oil and communicates the neutralized crude oil to a next sequential separation container to a last separation container. The last separation container delivers the treated crude oil. The neutralized crude oil floats to the top of the separation containers and is removed therefrom and dewatered. The treated crude oil contains less sulfur content than the crude oil. The treated crude oil also has a higher API value (American Petroleum Institute), (lower density and lower specific gravity). The crude oil becomes lighter (lower molecular weight and/or lower density) and more flowable (lower viscosity) than before the treatment with the aqueous solution due to the removal of sulfur, shale, dirt, heavy molecules of inert, and organic substances. In addition to the two primary benefits, the spent water by-product, obtained or collected as a result of the four-phase sequential processing, may be designated for possible use in commercial agriculture to grow crops, grasses, or vegetation. The spent water contains sulfur, potassium, iron, manganese, and other minerals which are of value to commercial agriculture to grow crops or grasslands. Further, the treated crude oil contains, for example, a 45 percent to 75 percent, 50 percent to 70 percent, or 55 percent to 65 percent less sulfur content than before the treatment with the aqueous solution containing the metal ion catalyst. The treated crude oil can optionally be further processed, for example, by storing in a holding tank or injecting into a pipeline. The remaining water phase contains the metal ion catalysts which can be recharged and reused for further sulfur removal processing.

Throughout the system according to examples of the present disclosure, a controller 125 is operatively coupled to pumps/valves 121 to control the flow of liquids, crude oil, or chemicals through pipes 122, tubing or plumbing, such as a 4" steel pipe. The controller 125, in certain examples, is an electronic device configured to execute instruction that cause the electronic device to command the pumps/valves 121 to control the flow of the crude oil through the system 100. The controller 125, in certain examples, is implemented using software, hardware, firmware or a combination thereof. When software is used, the operations performed by the controller 125 are implemented using, for example, program code configured to run on a processor unit. When firmware is used, the operations are implemented using, for example, program code and data stored in persistent memory to run on a processor unit. When hardware is used, the hardware includes one or more circuits that operate to perform the operation of controlling the pumps/valves. The hardware, in certain examples, takes the form of a circuit system, an integrated circuit, an application specific integrated circuit (ASIC), a programmable logic device, etc.

The controller 125 is a programmed or programmable electrical hardware unit where the equipment requiring electricity to operate is connected. The controller or "electrical hardware box" supplies electricity to pumps, opens valves, closes valves, turns on air compressors, turns on/off chemical injection systems, basically allows the mixture of chemicals, water and crude oil, and controls the directional flow of the crude oil through the entire process as the crude is treated (e.g., Phase1, Phase2, Phase3, and/or Phase4).

In some examples, some of the devices requiring electricity (e.g., controller itself, pumps, valves, compressors) in the system are supplied electricity by a generator 123 (e.g., gas or diesel). A generator is included in the system design and engineering to be a source of electricity for operating this system in remote areas; or in areas to operate off the grid, or in areas where electricity is limited and may not be available, or on a customer site where operating this system can be performed independently of electrical resources.

One or more electrical generators 123 are included in the engineering design to supply electrical power to the entire system; to operate in situ on a remote site.

The controller 125, in some examples, is also configured to communicate with various sensors 127, and in response to information received from the sensors 127, direct the flow of the crude oil. In certain examples, the sensors 127 include sulfur and/or pH sensors. For example, tank 104 and 119 may include a sulfur sensor, located in the crude oil portion of the column that indicates when a sulfur content of the crude oil is above or belowa predetermined threshold (e.g., 1% or 1.5% by volume/weight of sulfur). In response to this determination, the controller 125 is configured to route the crude oil back to tank 104, alkaline processing container, from tank 119, acid processing container, for another pass through the alkaline processing station 101 instead of passing the crude oil to the neutralization station 103 when the sulfur content in the processed crude oil exceeds the set threshold (e.g., greater than >1% sulfur).

In controller 125, in a further example, allows the operator to set pH ranges of the aqueous solution at each processing phase. The pH sensors are useful to determine if sufficient alkaline solution or acid solution has been added to cause the crude oil to enter the alkaline state or the acid state. In one example, the pH sensors are located on tank 104, alkaline processing container, on tank 107, acid processing container, and on tank 109, neutralization processing container. The pH sensor is located or positioned in the water column below the crude oil to read the pH of the aqueous solution. Knowing aqueous solution pH at each processing stage; alkaline processing, acid processing, neutralization stage, allows the operator more control over processing the crude oil to effectively remove sulfur content. The controller 125, although depicted as part of the alkaline processing station 101, may be positioned anywhere, and may be remote and configured to communicate with the sensors 127, and pumps/valves 121 over a network. The controller 125 is described in greater detail below with reference to FIG. 15. Containers or tanks are capable of fluidly communicating with each other through pipes 122. In some examples, some or all electronic devices (e.g., controller 125, pumps/valves 121) in the system are powered by one or more generators 123 (e.g., a gas/diesel electrical generator).

The system according to examples of the present disclosure may further include an aeration system 114, 115 that supplies compressed air to at least one of the alkaline processing container 104, the acid processing container 107, and the neutralization processing container 109

In certain examples, the aeration system 114, 115 includes a heat generation system configured to supply external heat to any one of the containers or tanks. As exemplified in FIG. 2 and FIG. 5, the system 100 further comprises an alkaline solution (Phase 1) containing an aqueous metal catalyst (dissolution of a metal of iron, zinc, potassium, manganese, potassium, permanganate, etc.) recovery tank 111. The alkaline aqueous solution metal catalyst is recovered from the processes in Phase 1—alkaline process from the water or aqueous column and redirected back to a recovery tank 111. The aqueous alkaline solution and metal catalysts from each tank in Phase1 (alkaline treatment of crude oil phase) is recaptured or recovered and redirected back to the Alkaline recovery tank for reuse in the Phase1 process. Phase1 is the alkaline aqueous solution treatment process of crude oil. In particular, the aqueous metal catalyst recovery tank 111 recovers the first alkaline aqueous solution from and recycles it back to the alkaline processing container 104.

Controller 125 includes logical decision making that allows the operator control over the recycled aqueous material and control over adjusting the recharging of the alkaline solution and metal catalyst, the acid solution and metal catalyst, and the neutralization solution (alkaline) and metal catalyst.

Referring again to FIG. 1, the system 100 further comprises an aqueous metal catalyst recovery tank 112 that recovers the acid aqueous solution from and recycles it back to the acid processing container 107; and an aqueous metal catalyst recovery tank 113 that recovers the second alkaline aqueous solution from and recycles it back to the neutralization processing container 109.

Figure 5:
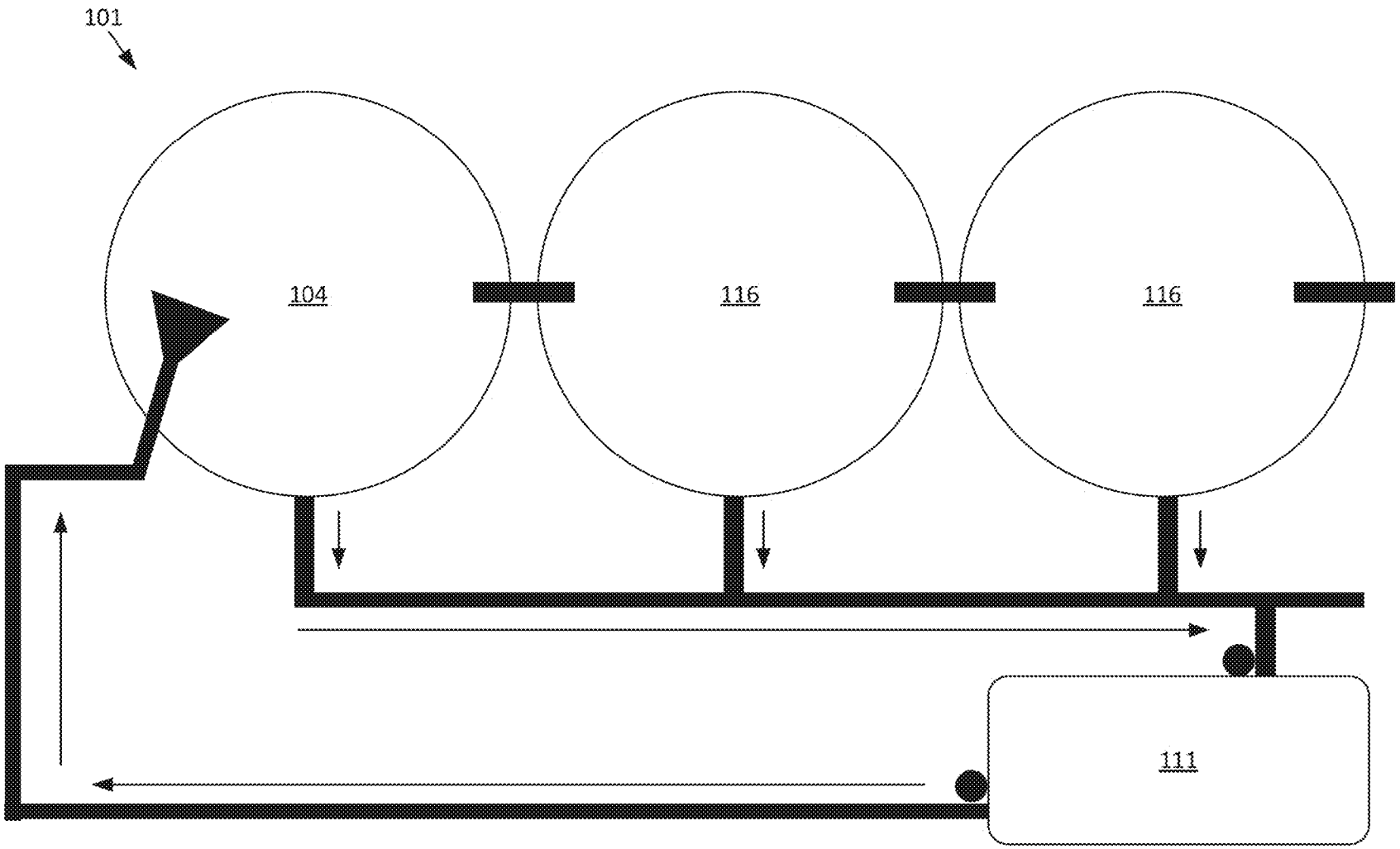
FIG. 5 is a partial view of alkaline processing containers and an aqueous metal catalyst recovery tank connected to each other by pipes, according to an example of the present disclosure.

While FIG. 5 depicts an exemplary portion of the alkaline processing station 101, the same or similar configuration may be implemented for the acid processing container 107, 118, 119 and the aqueous metal catalyst recovery tank 112 in the acid processing station 102 and/or the naturalization processing container 109, 120 and the aqueous-metal catalyst recovery tank 113 in the naturalization processing station 103.

Figure 6:
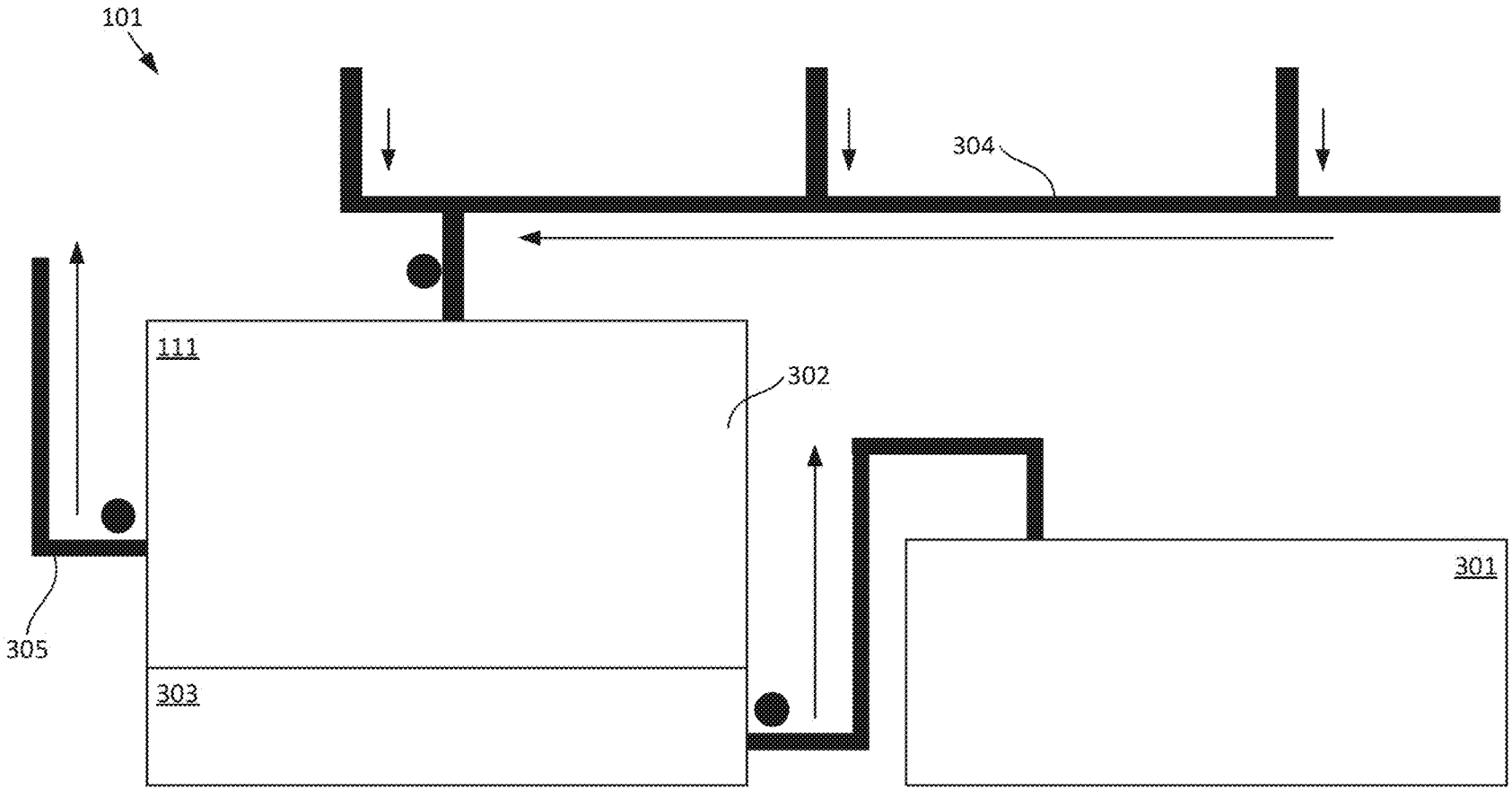
FIG. 6 is a schematic diagram of an aqueous metal catalyst recovery tank and a dewatered sludge tank, according to an example of the present disclosure.

FIG. 6 depicts an example wherein the aqueous metal catalyst recovery tank 111 is fluidly communicated to a dewatered sludge tank 301. A used alkaline aqueous solution 302 flows to the aqueous metal catalyst recovery tank 111 through a tube 304. The used alkaline aqueous solution 302 is adjusted or recharged with an alkaline concentrate that is supplied from the alkaline chemical pump/tank containing potassium hydroxide or similar alkaline agent. As the crude oil containing sulfur is processed, a portion of the hydroxide is "used in the reaction" or consumed in the chemical reaction. A portion of the separated sulfur forms into a salt/metal (e.g. iron sulfate, zinc sulfate, potassium sulfate) and a portion of the metals catalysts are chemically bound to form salts.

While FIG. 6 depicts an example of the aqueous metal catalyst recovery tank 111 communicated to the dewatered sludge tank 301 in the alkaline processing station 101, the same or similar configuration may be implemented for the aqueous metal catalyst recovery tank 112 in the acid processing station 102, and/or the aqueous metal catalyst recovery tank 113 in the naturalization processing station 103.

The front end of the alkaline processing tanks 104, 116, 117 are re-supplied with alkaline chemical and metal catalysts. A portion of the alkaline chemical and metal catalysts are supplied from the recycled alkaline solution collected in the alkaline recovery tank 302, and a portion of the chemical supplied is directly from the alkaline chemical drum and dispensing unit located at the front left of the system. Recycling of the chemicals provides lower operating costs and better use of the recycled aqueous liquids In one example, recharging the alkaline aqueous solution includes passing the alkaline aqueous solution through a bed of ion exchange media or by passing a recharging current through the solution.

The recovered alkaline aqueous solution corresponds to the water phase in the water-oil mixture. This recovery may occur when the crude oil is separated from the water-oil mixture in the alkaline processing container 104, 116 and 117. FIG. 6, a sludge 303 is pumped into the dewatered sludge tank 301 and collected therein.

Figure 7:
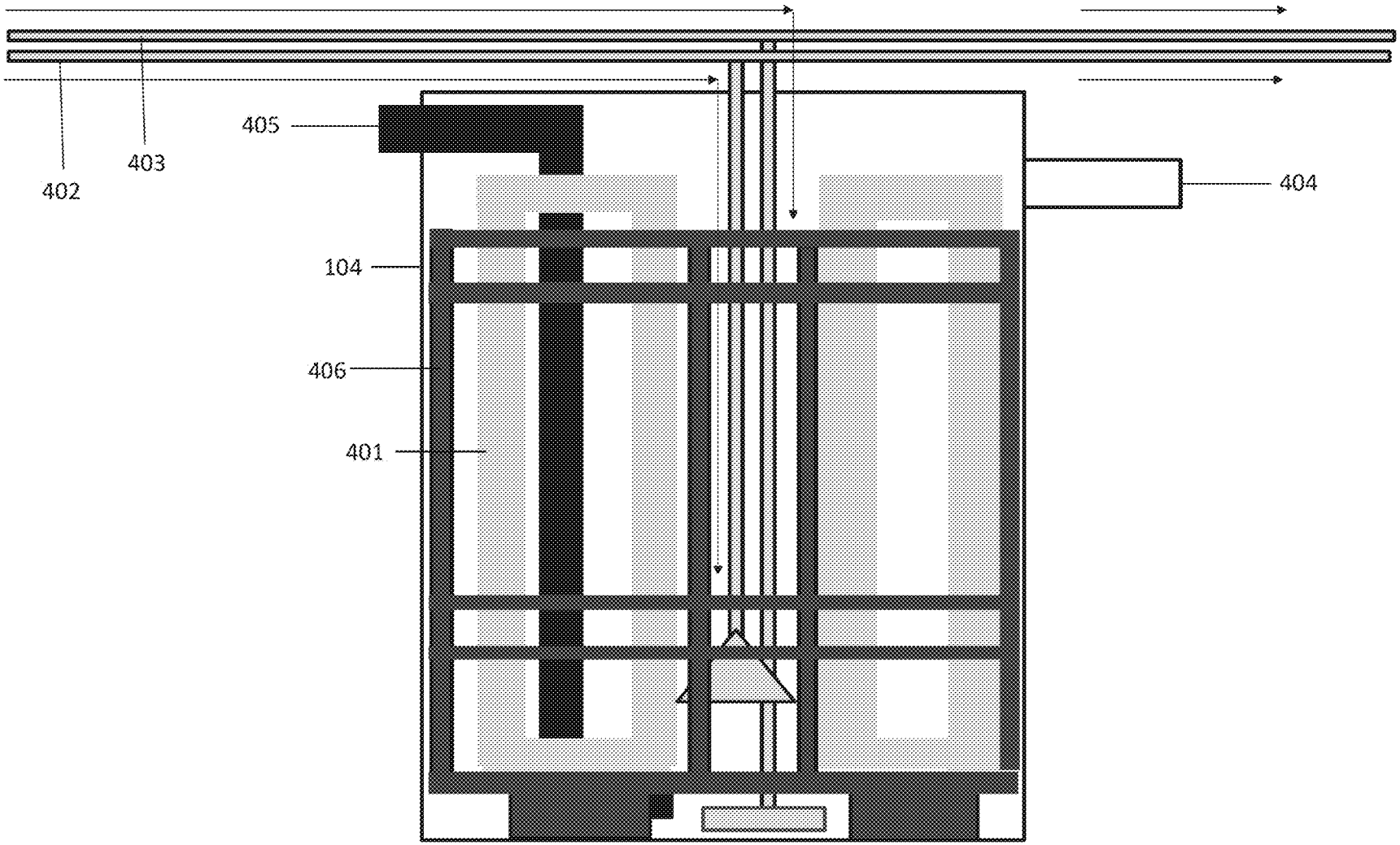
FIG. 7 is a partial view of an alkaline processing container, according to an example of the present disclosure.

In some examples, at least one of the alkaline processing containers, the acid processing containers, or the neutralization containers comprises a metal ion generation system. FIG. 7 shows a partial view of the first alkaline processing container 104 having a metal ion generation system 401, 406. The metal ion generation system 401, 406 comprises at least one perforated copper tube 401 tilled with metals including, but not limited to, iron, zinc, copper, potassium permanganate, manganese, potassium, sodium, magnesium, aluminum, lithium, or a mixture thereof.

The perforated copper tubes FIG. 7-FIG. 12 allow the alkaline aqueous solution to penetrate the catalyst tubes, contact the metals, causing an immediate catalytic reaction. The copper catalyst tubes may be located in each process tank (e.g., alkaline processing tank, acid processing tank, and neutralization tank) and are filled with, for example, iron powder and/or granules, and zinc powder and/or granules. These materials act as a catalyst and are activated in the presence of the alkaline solution made with solubilized dissimilar metals and metal ions. Addition of potassium permanganate to the four-phase sequential processing (i.e., Phase 1 (alkaline phase); Phase 2 (acid phase); Phase 3 (neutralization phase); and Phase 4 (separation phase)) further increases the active ionization level and boosts the effect of the metal ion catalysts contained in the water-oil mixture.

In certain examples, potassium permanganate increased the ionic charge levels of the metal catalysts in both the alkaline process phase (Phase 1) and in the acid phase (Phase 2). The result is an increased reduction in sulfur in treated crude oil. The at least one perforated copper tube 401 is supported by iron metal plates or metal bars 406. Crude oil 405 enters the first alkaline processing container 104, through the bottom in certain examples, which enables increased interaction between the crude oil 405 supplied from the crude oil source 105 and first alkaline aqueous solution 402 supplied from the alkaline solution tank 106.

Compressed air 403 generated from the aeration system 114 is provided to the first alkaline processing container 104 to the bottom, to help mix the crude oil 405 and the first alkaline aqueous solution 402, boost the chemical reaction rate, and supply oxygen to the mixture. In certain examples, diffusers are added to the aeration system 114 for the supply of oxygen and set at different right angles to mix the crude oil 405 and the first alkaline aqueous solution 402. The addition of oxygen gas bubbles through the diffusers can aid in expanding, separating and lifting the crude oil 405 from the water column resulting in a better more efficient separation of oil. This method of mixing, by using oxygen and compressed air along with a mechanical method of mixing of crude oil 405 in the processing container, allows more contact between the chemical and the crude oil. Alternatively, or concurrently, a propeller-type mechanical mixing system can be used to create a vortex, mixing the aqueous solution and crude oil vertically and horizontally, thus further increasing contact between the chemical solution and the crude oil.

Alkaline-treated crude oil 404 is generated and moved to the next subsequent alkaline processing container 116, 117. While FIG. 7 depicts the first alkaline processing container 104, the same or similar configuration and effect is applicable to other alkaline processing containers 116, 117, the acid processing containers 107, 118, 119 or the aqueous metal catalyst recovery tank or neutralization processing containers 109, 120.

Figure 8:
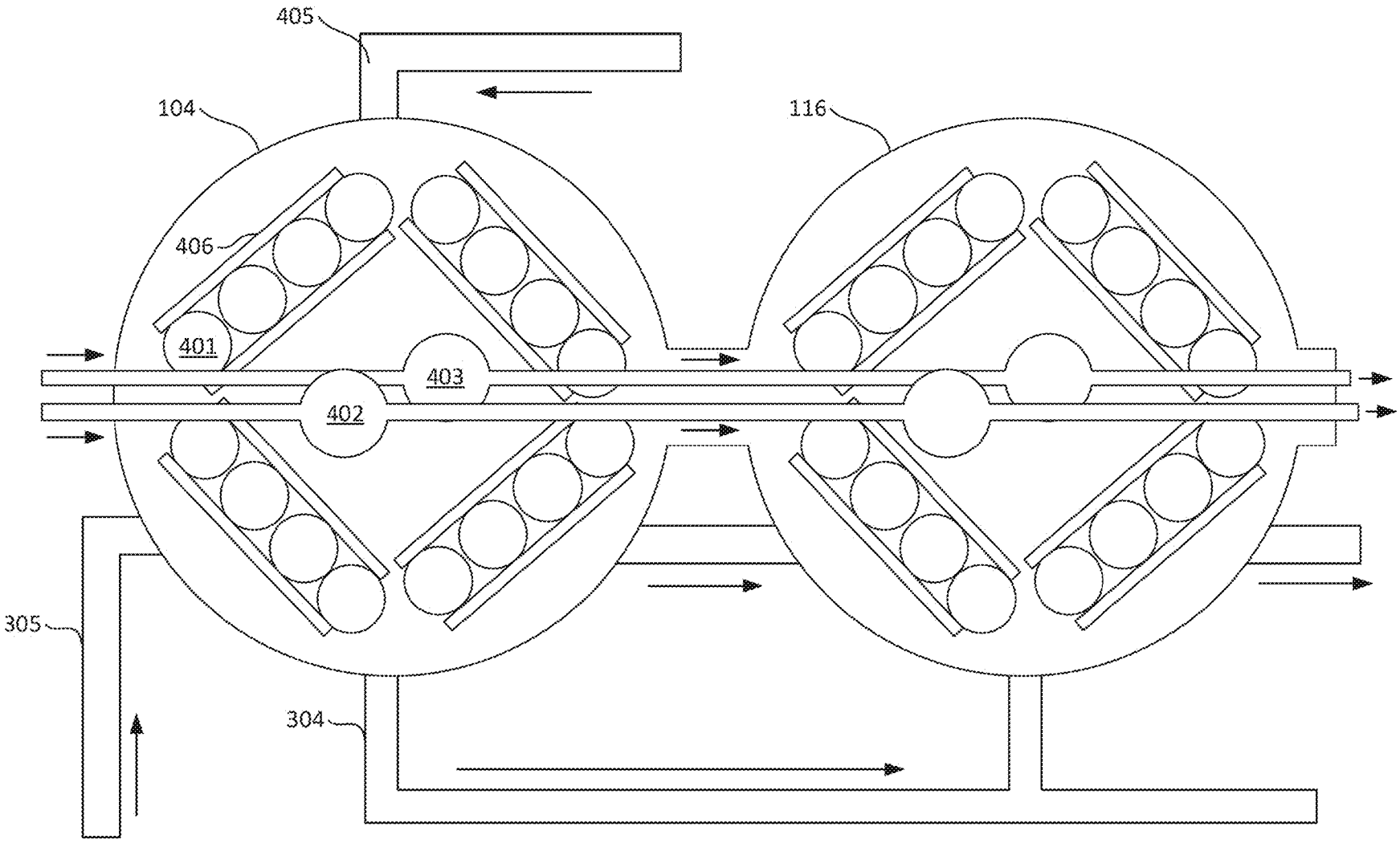
FIGS. 8-10 are a top view of alkaline processing containers containing perforated copper tubes filled with metals, according to three different examples of the present disclosure.

FIG. 8 is a top view of alkaline processing containers and pipes connected to the alkaline processing container according to an example of the present application. Four sets of four copper tubes 401 (total sixteen copper tubes) are provided in each of the alkaline processing containers 104 and 116. Each set of four copper tubes may be placed between two iron metal plates or metal bars 406. Each set of four copper tubes is placed such that the first alkaline aqueous solution 402 and the compressed air 403 can be placed in the middle of the alkaline processing containers 104 and 116. This design allows the alkaline chemical to have greater surface area contact with the dissimilar metals in the aqueous phase and generate metal ions.

Figure 9:
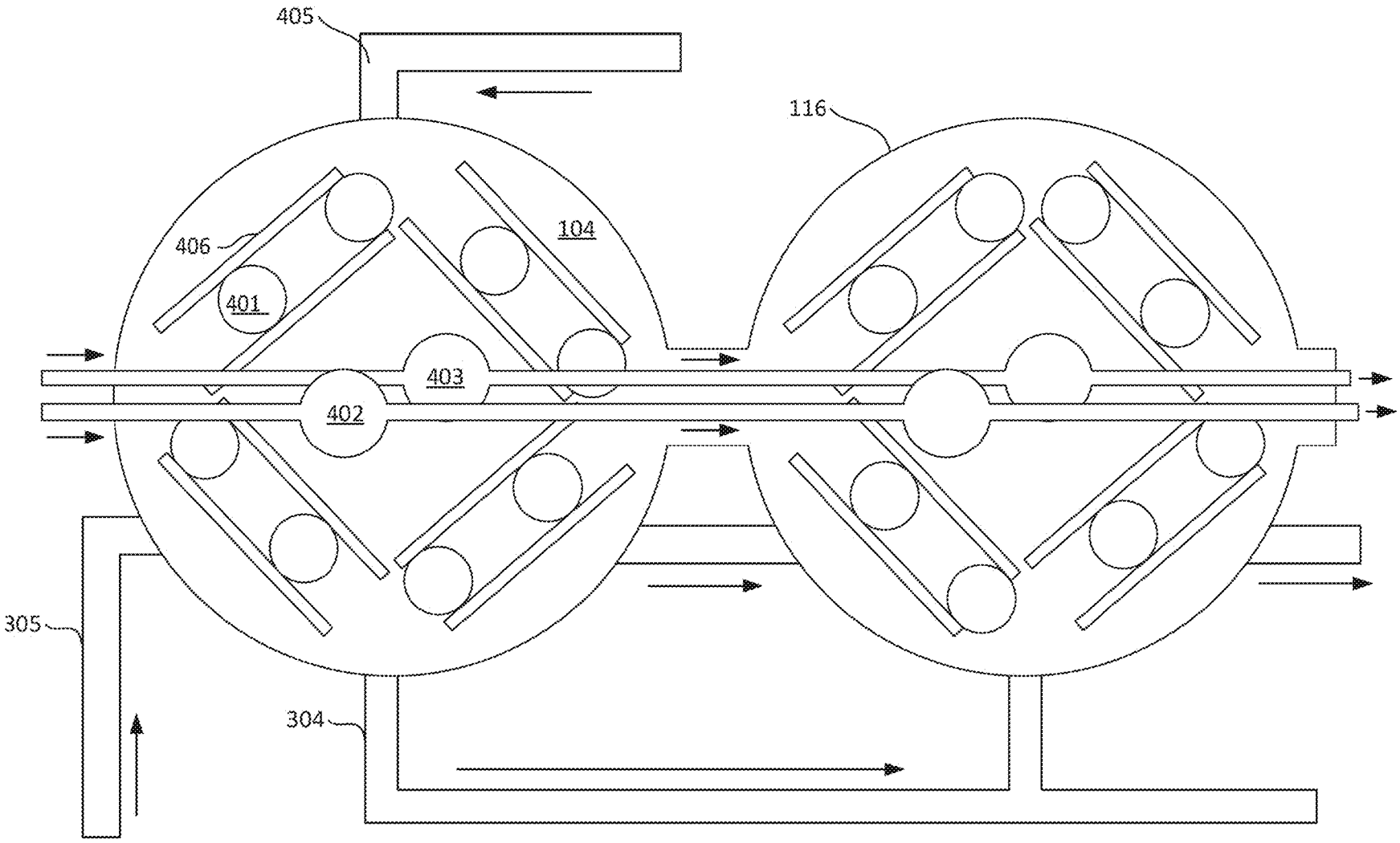

Alternatively, in FIG. 9, four sets of two copper tubes 401 (total eight copper tubes) are provided in each of the alkaline processing containers 104 and 116. Each set of two copper tubes is placed between two iron metal plates or metal bars 406. Each set of two copper tubes are placed such that the first alkaline aqueous solution 402 and the compressed air 403 can be placed in the middle of the alkaline processing containers 104 and 116.

Figure 10:
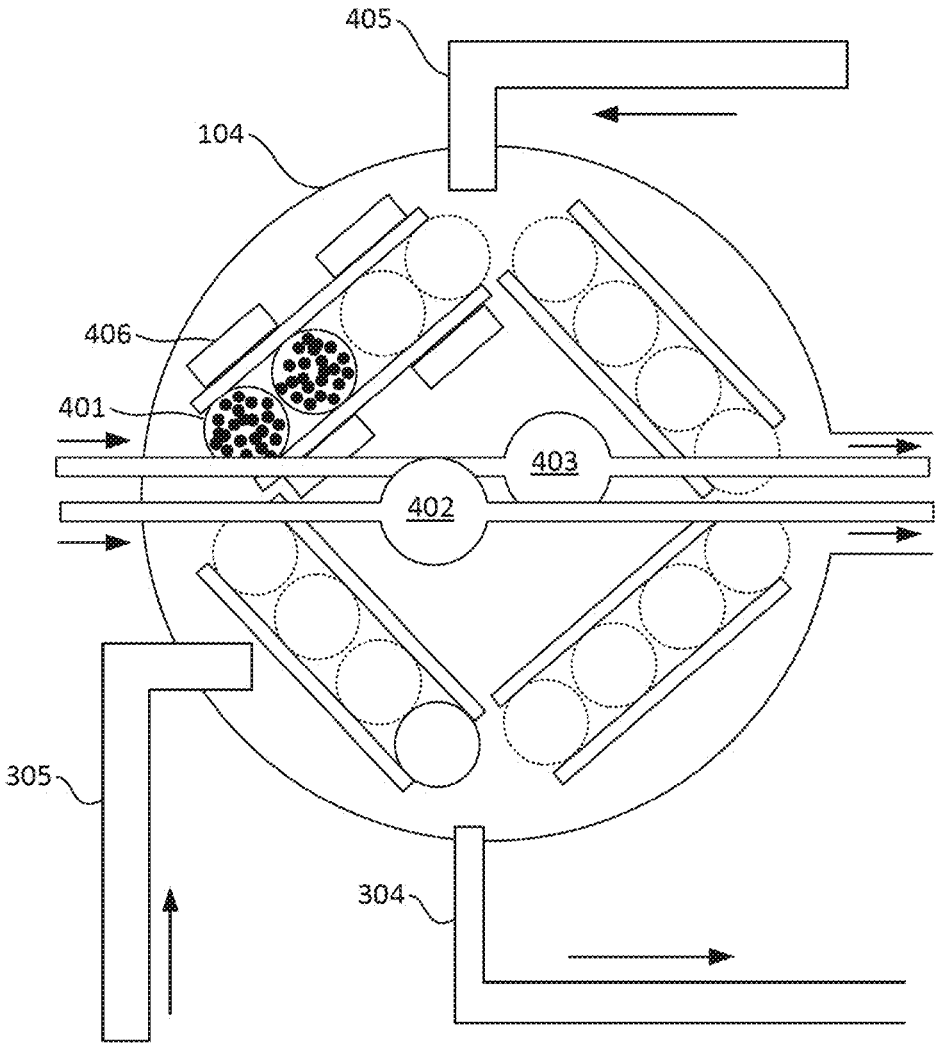
Figure 11:
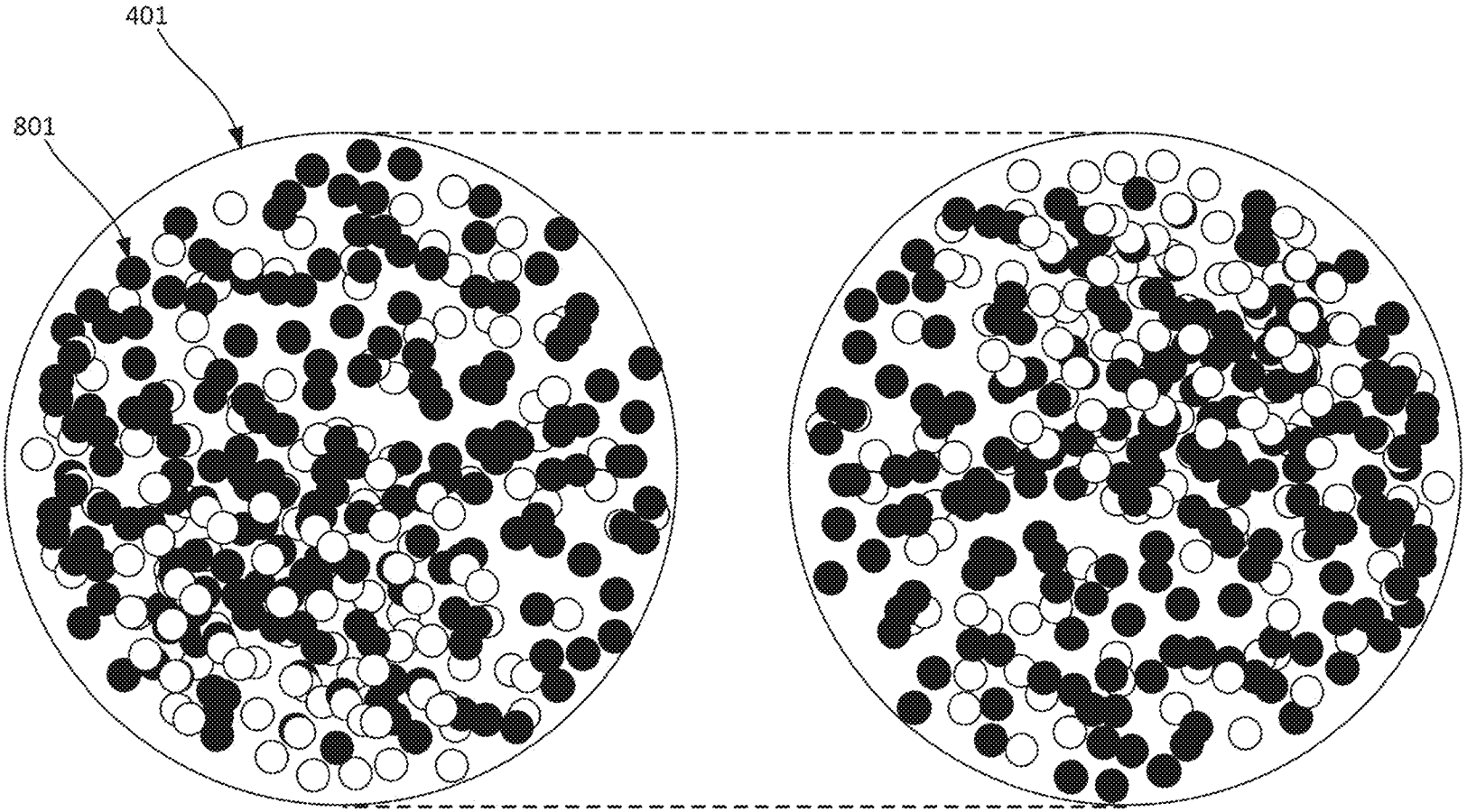
FIG. 11 is a top view of copper tubes filled with metals, according to an example of the present disclosure.
Figure 12:
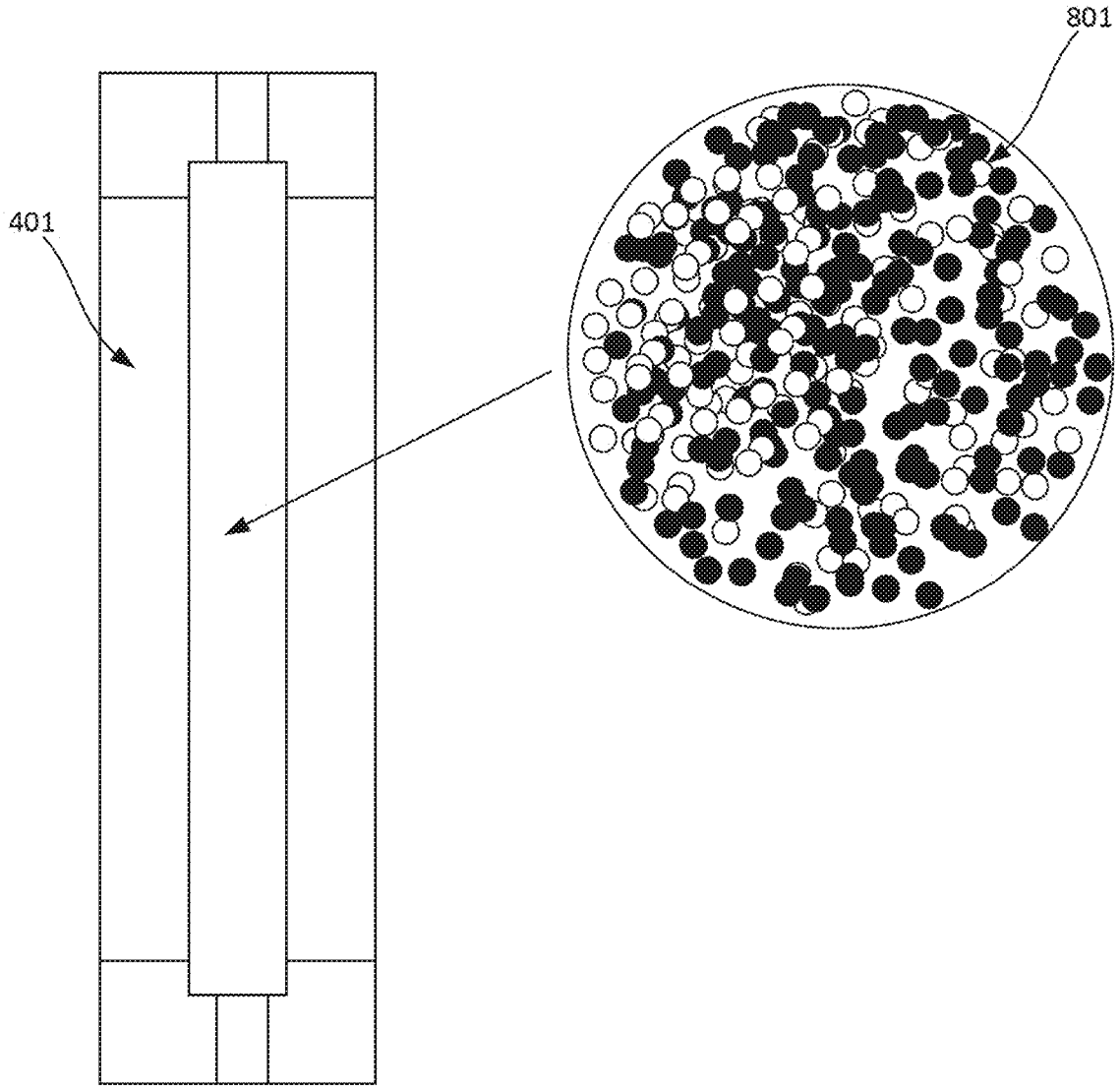
FIG. 12 is a section view of copper tubes filled with metals, according to an example of the present disclosure.

Alternatively, in FIG. 10, four sets of four copper tubes 401 (total sixteen copper tubes) are provided in the alkaline processing container 104. Each set of four copper tubes is placed between two iron metal plates or metal bars 406. Each set of four copper tubes are placed such that the first alkaline aqueous solution 402 and the compressed air 403 can be placed in the middle of the alkaline processing containers 104 and 116. As shown in FIGS. 11 and 12 as well, two perforated copper tubes are attached to each other, filled by metal powders and/or granules 801 comprising iron, zinc, copper, potassium permanganate, manganese, potassium, sodium, magnesium, aluminum, lithium, or a mixture thereof. These metals become electrically charged when in the presence of the alkaline solution made with solubilized metals and metal ions. The perforations of the copper tubes allow the alkaline solution to penetrate the catalyst tubes and contact the metals, causing an immediate catalytic reaction. The charged solution cycles back into the alkaline process tank. In some examples, the total number of copper tubes can be between 8 and 16 per tank, or any other reasonable number. The copper tubes are, in certain examples, 2" and are removable and rechargeable.

Figure 13:
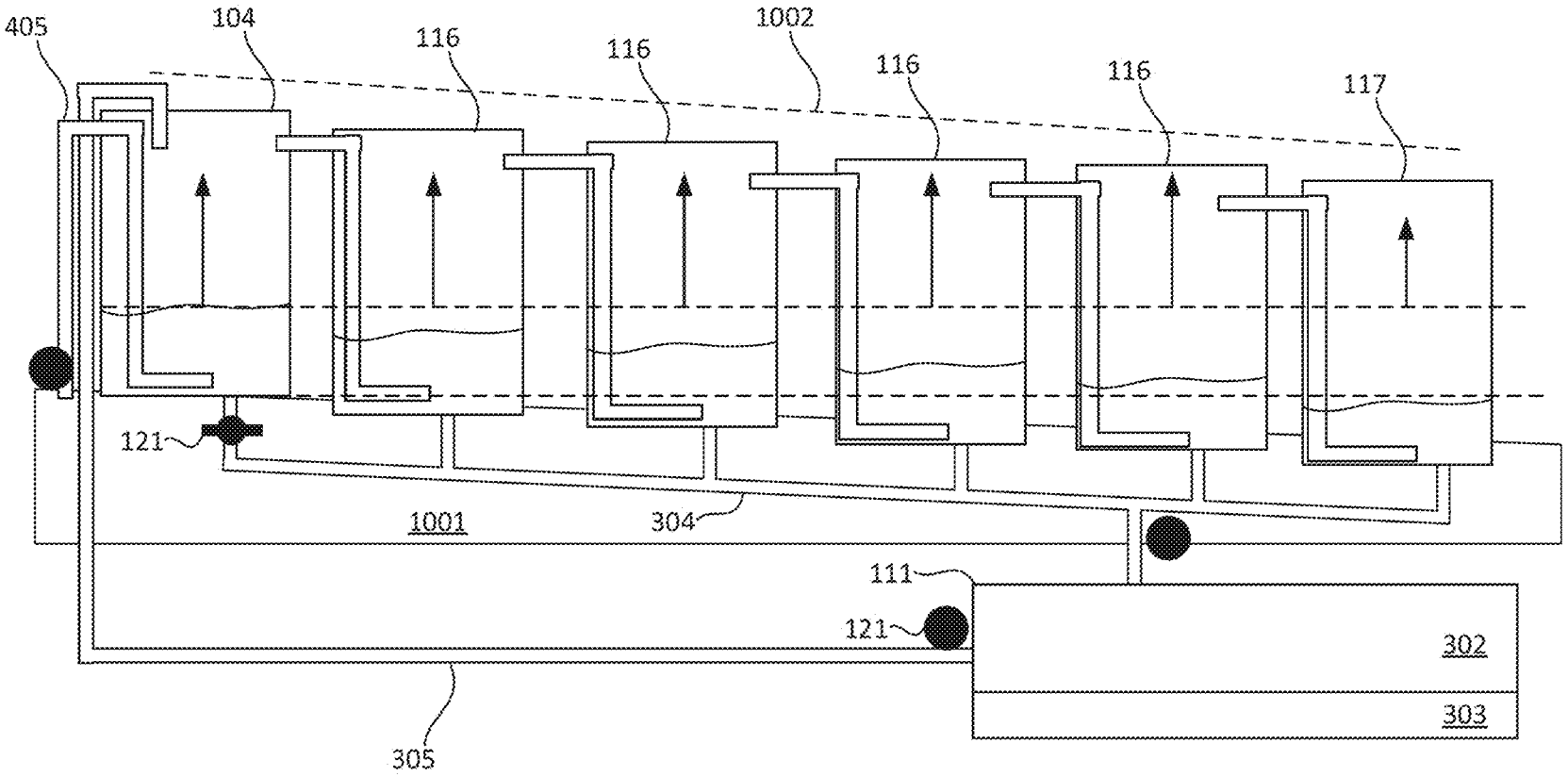
FIG. 13 is a schematic diagram of alkaline processing containers and a metal catalyst ion recovery system connected by pipes wherein a flow is made by gravity, according to an example of the present disclosure.
Figure 14:
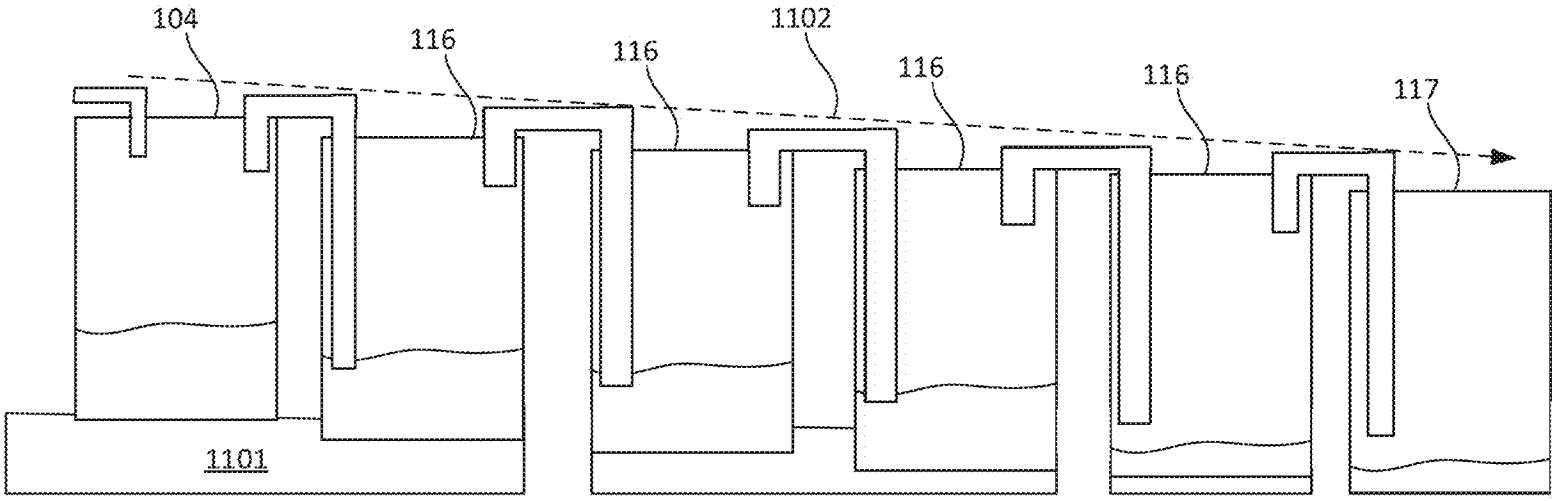
FIG. 14 is a schematic diagram of alkaline processing containers wherein a flow is made by gravity, according to an example of the present disclosure.

FIG. 13 shows an example where communication between one alkaline processing container 104, 116, 117 with another alkaline processing container 104, 116, 117 is facilitated by a gradually sloped ground 1001. The slope is also represented by 1002. FIG. 14 shows an alternative example where communication between one alkaline processing container 104, 116, 117 and another alkaline processing container 104, 116, 117 is facilitated by different number of layers 1101 placed below each alkaline processing container, thereby creating a step-like slope. The slope is also represented by 1102.

Figure 15:
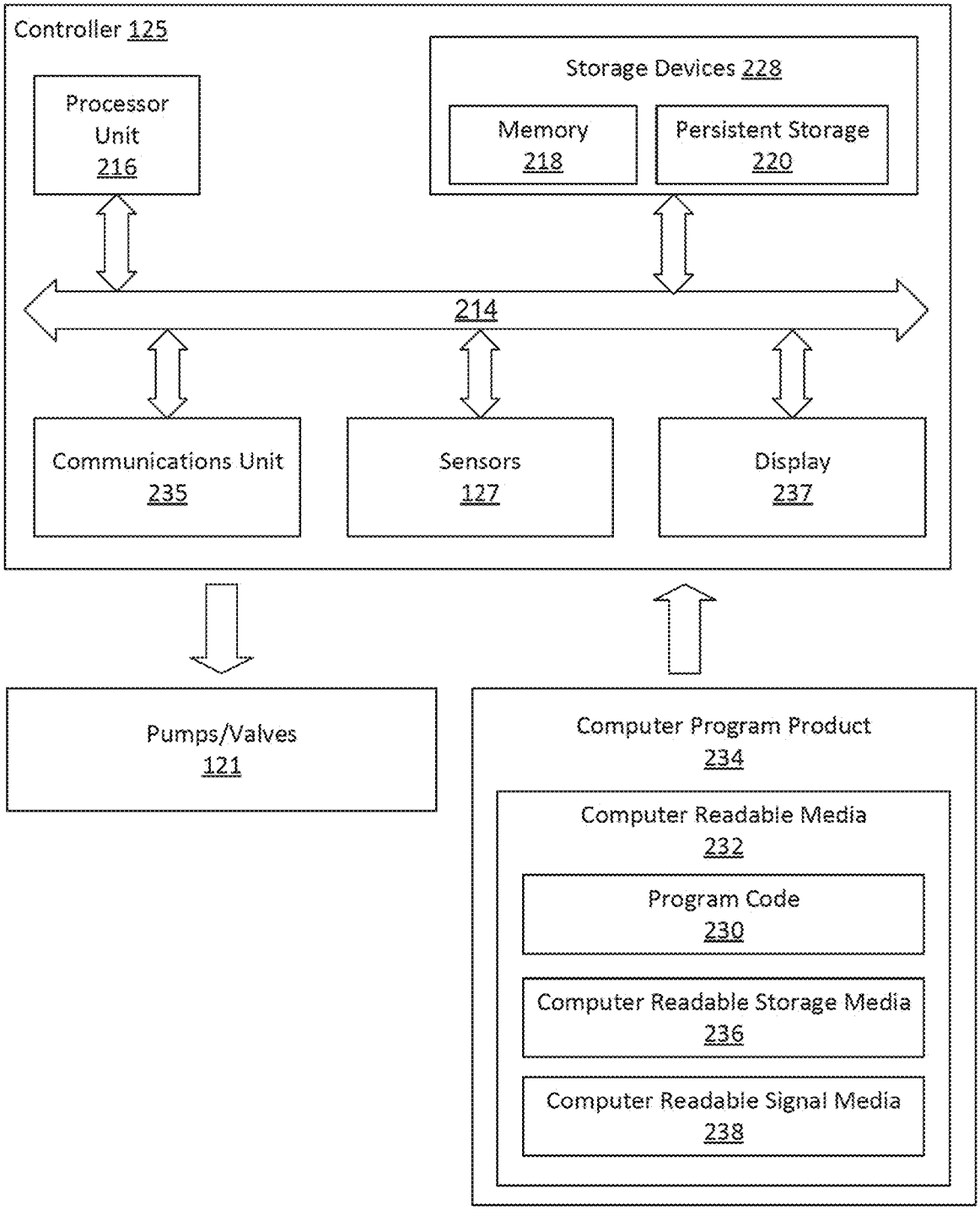
FIG. 15 is a schematic block diagram of a controller, according to an example of the present disclosure.

FIG. 15 is a schematic block diagram illustrating the controller 125, according to examples of the subject disclosure. The controller 125 is an example of a computing device, which, in some examples, is used to implement one or more components of examples of the disclosure, and in which computer usable program code or instructions implementing the processes can be located for the illustrative examples. In this illustrative example, the controller 125 includes a communications fabric 214, which provides communications between a processor unit 216, memory 218, persistent storage 220, a communications unit 235, and a display 237.

The processor unit 216 serves to execute instructions for software that are loaded into memory 218 in some examples. In one example, the processor unit 216 is a set of one or more processors or can be a multi-processor core, depending on the particular implementation. Further, the processor unit 216 is implemented using one or more heterogeneous processor systems, in which a main processor is present with secondary processors on a single chip, according to some examples. As another illustrative example, the processor unit 216 is a symmetric multi-processor system containing multiple processors of the same type.

Memory 218 and persistent storage 220 are examples of storage devices 228. A storage device is any piece of hardware that is capable of storing information, such as, for example, without limitation, data, program code in functional form, and/or other suitable information either on a temporary basis and/or a permanent basis. Memory 218, in these examples, is a random-access memory, or any other suitable volatile or non-volatile storage device. Persistent storage 220 takes various forms, depending on the particular implementation. In one example, persistent storage 220 contains one or more components or devices. In an example, persistent storage 220 is a hard drive, a flash memory, a rewritable optical disk, a rewritable magnetic tape, or some combination of the above. The media used by persistent storage 220 is removable in some examples. For example, a removable hard drive is used for persistent storage 220 in various implementations.

The communications unit 235, in these examples, provides for communication with other data processing systems or devices. In these examples, the communications unit 235 is a network interface card. The communications unit 235 provides communications through the use of either, or both, physical and wireless communications links. In some examples, the communication unit 235 also provides a connection for user input through a keyboard, a mouse, and/or some other suitable input device. Further, the input/output unit sends output to a printer or receive input from any other peripheral device in various examples. The display 237 provides a mechanism to display information to a user.

In some examples, instructions for the operating system, applications, and/or programs are located in the storage devices 228, which are in communication with the processor unit 216 through the communications fabric 214. In these illustrative examples, the instructions are in a functional form on persistent storage 220. These instructions are loaded into memory 218 for execution by the processor unit 216 in some examples. In certain examples, the processes of the different examples are performed by the processor unit 216 using computer implemented instructions, which is located in a memory, such as the memory 218.

These instructions are referred to as program code, computer usable program code, or computer readable program code that can be read and executed by a processor in the processor unit 216. The program code, in the different examples, is embodied on different physical or computer readable storage media, such as the memory 218 or the persistent storage 220.

Program code 230 is located in a functional form on computer readable media 232 that is selectively removable and can be loaded onto or transferred to the controller 125 for execution by the processor unit 216. In some examples, the program code also contains the computer-aided design of the part 126. The program code 230 and computer readable media 236 form computer program product 234. In one example, the computer readable media 232 is a computer readable storage media 236 or a computer readable signal media 238. The computer readable storage media 236 includes, in one example, an optical or magnetic disc that is inserted or placed into a drive or other device that is part of the persistent storage 220 for transfer onto a storage device, such as a hard drive, that is part of the persistent storage 220. In other examples, the computer readable storage media 236 also takes the form of a persistent storage, such as a hard drive, a thumb drive, or a flash memory that is connected to the controller 125. In some instances, the computer readable storage media 236 is not removable from the controller 125.

Alternatively, the program code 230 is transferred to the controller 125 using computer readable signal media 238. Computer readable signal media 238 is, as one example, a propagated data signal containing program code 230. For example, the computer readable signal media 238 is an electromagnetic signal, an optical signal, and/or any other suitable type of signal in one example. These signals are transmitted over communications links, such as wireless communication links, an optical fiber cable, a coaxial cable, a wire, and/or any other suitable type of communications link. In other words, the communications link and/or the connection is physical or wireless in the illustrative examples. The computer readable media also takes the form of non-tangible media, such as communications links or wireless transmissions containing the program code, in some examples.

In some illustrative examples, the program code 230 is downloaded over a network to the persistent storage 220 from another device or data processing system through the computer readable signal media 238 for use within the controller 125. In one instance, program code stored in a computer readable storage media in a server data processing system is downloaded over a network from a server to the controller 125. According to various examples, the system providing the program code 230 is a server computer, a client computer, or some other device capable of storing and transmitting program code 230.

The different components illustrated for the controller 125 are not meant to provide physical or architectural limitations to the manner in which different examples can be implemented. The different illustrative examples can be implemented in a controller including components in addition to and/or in place of those illustrated for the controller 125. Other components shown in FIG. 15 can be varied from the illustrative examples shown. The different examples can be implemented using any hardware device or system capable of executing program code. For example, a storage device in the controller 125 is any hardware apparatus that can store data. The memory 218, persistent storage 220, and the computer readable media 232 are examples of storage devices in a tangible form.

In another example, a bus system is used to implement communications fabric 214 and can be comprised of one or more buses, such as a system bus or an input/output bus. Of course, in some examples, the bus system is implemented using any suitable type of architecture that provides for a transfer of data between different components or devices attached to the bus system. In additional examples, a communications unit includes one or more devices used to transmit and receive data, such as a modem or a network adapter. Further, a memory is, for example, the memory 218 or a cache such as found in an interface and memory controller hub that can be present in the communications fabric 214.

Computer program code for carrying out operations for aspects of the subject disclosure can be written in any combination of one or more programming languages, including an object-oriented programming language such as Java, Smalltalk, C++ or the like and conventional procedural programming languages, such as the "C" programming language or similar programming languages. The program code can execute entirely on the user's computer, partly on the user's computer, as a stand-alone software package, partly on the user's computer and partly on a remote computer or entirely on the remote computer or server. In the latter scenario, the remote computer can be connected to the user's computer through any type of network, including a local area network (LAN) or a wide area network (WAN), or the connection can be made to an external computer (for example, through the Internet using an Internet Service Provider).

These computer program instructions can also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks. The computer program instructions can also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

Figure 16:
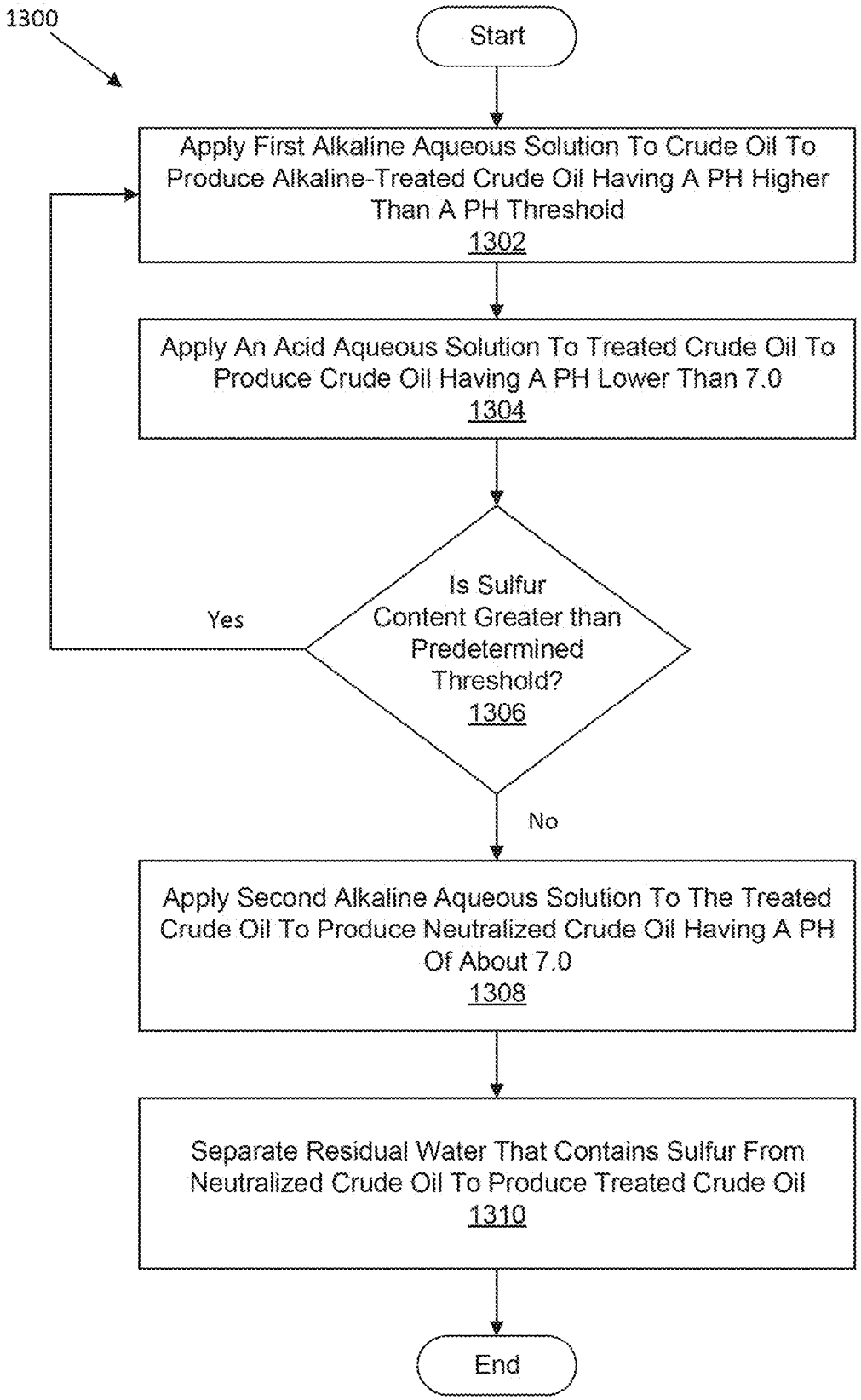
FIG. 16 is a flowchart diagram illustrating one example of a method for reducing the sulfur content of crude oil, according to an example of the present disclosure. This diagram illustrates establishing a predetermined threshold on sulfur levels in processed crude oil (e.g., 1% or 1.5%) and managing the operating system to meet this threshold to include reprocessing treated crude oil that has sulfur levels above threshold specifications.

Turning now to FIG. 16 shown is a method 1300 for sulfur reduction of crude oil, according to examples of the subject disclosure. The method 1300, in certain examples, is performed by the system 100, as described above. In certain examples, the controller 125 controls pumps, valves, sensors, etc., to perform the steps of the method 1300. The method 1300 begins and, at block 1302, a first alkaline aqueous solution is applied to crude oil to produce alkaline-treated crude oil having a pH greater than a pH threshold. In certain examples, the pH threshold is about 7.0. At block 1304, the method 1300 includes applying an acid aqueous solution to the alkaline-treated crude oil to produce crude oil having a pH lower than the pH threshold.

If, at decision block 1306, the controller 125 determines that sulfur content is greater than a predetermined sulfur threshold (e.g., 1% or 1.5% or 2% by weight sulfur), the method 1300 returns to block 1302. In this example, the controller 125 directs the crude oil back to the alkaline processing station 101, alkaline processing container 104, to apply another round of alkaline aqueous solution. This beneficially allows for the system 100 to cycle the crude oil through alkaline and acid phases multiple times if needed before neutralization. If, on the other hand, at decision block 1306 the controller 125 determines that the sulfur content is less than the predetermined sulfur threshold, the method continues to block 1308 and a second alkaline aqueous solution is applied to the treated crude oil to produce a neutralized crude oil having an aqueous solution pH of about 7.0. At block 1310, the method 1300 includes separating residual water that contains sulfur from the neutralized crude oil to produce treated crude oil.

Dwell times in each container or tank, in the above described examples, may range from about 5 to about 80 minutes. In certain exemplary examples, a dwell time of about 60 minutes has led to sulfur reduction, with ending sulfur levels in treated crude oil of about 1% to 2% depending on the metal ion catalysts. Although not all-inclusive, the below table (Table 1) identifies results of the present sulfur reduction method on the Zuata heavy crude oil using 60 minute dwell times on 5 different test runs.

TABLE 1

| Sample | Sulfur % after Processing by the System 100 | % Sulfur Reduction |
|---|---|---|
| Zuata 300 Control (not processed) | 3.57 | N/A |
| ZUATA 300 (Fe) + (FeO) + (Zn) + (KMn) | 1.26 | 64.7 |
| ZUATA 300 (Fe) + (FeO) + (Zn) + (KMn) | 1.43 | 59.9 |
| ZUATA 300 (Fe) + (FeO) + (Zn) + (KMn) | 1.70 | 64.7 |
| ZUATA 300 (Fe) + (FeO) + (Zn) + (KMn) | 1.42 | 60.3 |
| ZUATA 300 (Fe) + (FeO) + (Zn) + (KMn) | 1.67 | 53.2 |

The phases and chemical processes used to achieve the results of Table 1 include:

Phase 1—Alkaline cycle: Potassium hydroxide plus solubilized metal catalysts (Fe, FeO, Zn, KMn, Cu).

Alkaline cycle solution pH: 8.5 to 9.5

Solution pH=water+chemical+crude oil

Phase 2—Acid cycle: Phosphoric acid plus solubilized metal catalysts (Fe, FeO, Zn, KMn, Cu).

Acid cycle solution pH: 3.0 to 3.5

Solution pH=water+chemical+crude oil

Phase 3—Neutralization cycle: Potassium hydroxide plus solubilized metal catalysts (Fe, FeO, Zn, KMn, Cu).

Neutralization cycle solution pH: 6.5 to 7.0

Solution pH=water+chemical+crude oil

Phase 4—Separation and decanting cycle: separate the water from the oil by decanting water layer (water column) from bottom of tank. Oil separates and floats to top of the column.

Transfer processed crude oil to processed oil tank.

Separation cycle crude oil pH: 6.5 to 7.0

Using a similar process on another type of crude oil known as "West Texas Crude," resulted in a reduction of sulfur from 1.94% to about 0.65%, or about a 66% reduction of sulfur content. The systems and methods described here also work equally well on other types of crude oil, such as Southwest Texas heavy crude, Zuata heavy crude, Hamaca heavy crude, Basrah heavy crude, and Oklahoma heavy crude. In certain examples, the success of the sulfur reduction process is based on the chemical reaction and/or dwell time of the crude oil in each of the stations (or container/tank), an amount of heat generated from the exothermic reaction, and the combination of dissimilar metals (metal ion catalysts), the concentration of alkaline solution and acid solution used in the processing tanks. The different combinations of dissimilar metals beneficially provide increased variable charges in the aqueous alkaline or acid solutions. Unless defined otherwise, technical and scientific terms used herein have the same meaning as commonly understood by the person of ordinary skill in the art to which this disclosure belongs. Thus, the scope of the examples of the present disclosure should be determined by the appended claims and their legal equivalents.

It should be understood that the above description of the disclosure and specific examples, while indicating various examples of the present disclosure, are given by way of illustration and not limitation. Suitable changes and modifications within the scope of the present disclosure may be made without departing from the spirit thereof, and the present disclosure includes such changes and modifications.

What is claimed is:

1. A method for reducing sulfur content in crude oil comprising:

applying a first alkaline aqueous solution to crude oil to produce alkaline-treated crude oil having an aqueous solution pH higher than 7.0;

applying an acid aqueous solution to the alkaline-treated crude oil to produce acid-treated crude oil having an aqueous solution pH lower than 7.0;

applying a second alkaline aqueous solution to the acid-treated crude oil to produce neutralized crude oil having an aqueous solution pH about 7.0; and separating residual water that contains sulfur from the neutralized crude oil to produce treated crude oil, wherein at least one of the first alkaline aqueous solution, the acid aqueous solution, and the second alkaline aqueous solution comprises a metal ion catalyst, and whereby the treated crude oil contains less sulfur content than the crude oil.

2. The method of claim 1 further comprises recovering and recycling at least one of the first alkaline aqueous solution, the acid aqueous solution, and the second alkaline aqueous solution.

3. The method of claim 1 further comprises supplying compressed air to a location where at least one of the alkaline-treated crude oil, the acid-treated crude oil and the neutralized crude oil is being formed.

4. The method of claim 1 further comprises supplying metal ions to a location where at least one of the alkaline-treated crude oil, the acid-treated crude oil and the neutralized crude oil is being formed.

5. The method of claim 1 further comprises:

providing at least one alkaline processing container configured to receive the crude oil and the first alkaline aqueous solution and to deliver the alkaline-treated crude oil;

providing at least one acid processing container configured to receive the alkaline-treated crude oil and the acid aqueous solution and to deliver the acid-treated crude oil;

providing at least one neutralization container configured to receive the acid-treated crude oil and the second alkaline aqueous solution and to deliver the neutralized crude oil; and providing at least one separation container configured to receive the neutralized crude oil from the neutralization container, separate residual water that contains sulfur from the neutralized crude oil, and to deliver the treated crude oil.

6. The method of claim 5 wherein the at least one alkaline processing container comprises more than one alkaline processing container arranged in series, wherein a first alkaline processing container receives the crude oil and the first alkaline aqueous solution, produces the alkaline-treated crude oil and communicates the alkaline-treated crude oil to a last alkaline processing container.

7. The method of claim 5 wherein the at least one acid processing container comprises more than one acid processing container arranged in series, wherein a first acid processing container receives the alkaline-treated crude oil and the acid aqueous solution, produces the acid-treated crude oil, and communicates the acid-treated crude oil to a last acid processing container.

8. The method of claim 5 wherein the at least one neutralization container comprises more than one neutralization container arranged in series, wherein a first neutralization container receives the acid-treated crude oil and the second alkaline aqueous solution, produces the neutralized crude oil, and communicates the neutralized crude oil to a last neutralization container.

9. The method of claim 5 wherein the at least one separation container comprises more than one separation container arranged in series, wherein a first separation container receives the neutralized crude oil, produces a treated crude oil, and communicates the treated crude oil to a last separation container.

10. The method of claim 5 wherein at least one of the alkaline processing containers, the acid processing container, and the neutralization container comprises a metal ion generation system that comprises at least one perforated tube filled with one or more metals.

11. A system comprising:

an alkaline processing station comprising:

at least one alkaline processing container configured to receive crude oil having sulfur content and a first alkaline aqueous solution and deliver alkaline-treated crude oil having an aqueous solution pH higher than 7.0;

an acid processing station comprising:

at least one acid processing container configured to receive the alkaline-treated crude oil and an acid aqueous solution and deliver acid-treated crude oil having an aqueous solution pH lower than 7.0;

a neutralization station comprising:

at least one neutralization container configured to receive the acid-treated crude oil and a second alkaline aqueous solution and deliver neutralized crude oil having an aqueous solution pH about 7.0; and a separation station comprising:

at least one separation container configured to receive the neutralized crude oil, separate residual water that contains sulfur from the neutralized crude oil, and deliver treated crude oil, wherein at least one of the first alkaline aqueous solution, the acid aqueous solution, and the second alkaline aqueous solution comprise a metal ion catalyst, and whereby the treated crude oil contains less sulfur content than the crude oil.

12. The system of claim 11 further comprises an alkaline solution tank that supplies the first alkaline aqueous solution to the alkaline processing container; and an acid solution tank that supplies the acid aqueous solution to the acid processing container.

13. The system of claim 11 further comprises an alkaline solution tank that supplies the second alkaline aqueous solution to the neutralization container.

14. The system of claim 11 further comprises a first aqueous catalyst recovery tank that recovers the first alkaline aqueous solution from and recycles it back to the alkaline processing container; a second aqueous metal catalyst recovery tank that recovers the acid aqueous solution from and recycles back to the acid processing container; and a third aqueous metal catalyst recovery tank that recovers the second alkaline aqueous solution from and recycles back to the neutralization container.

15. The system of claim 11 further comprises an aeration system that supplies compressed air to at least one of the alkaline processing containers, the acid processing container, and the neutralization container.

16. The system of claim 11 wherein the at least one alkaline processing container comprises more than one alkaline processing container arranged in series, wherein a first alkaline processing container receives the crude oil and the first alkaline aqueous solution, produces the alkaline-treated crude oil and communicates the alkaline-treated crude oil to a last alkaline processing container.

17. The system of claim 11 wherein the at least one acid processing container comprises more than one acid processing container arranged in series, wherein a first acid processing container receives the alkaline-treated crude oil and the acid aqueous solution, produces the acid-treated crude oil, and communicates the acid-treated crude oil to a last acid processing container.

18. The system of claim 11 wherein the at least one neutralization container comprises more than one neutralization container arranged in series, wherein a first neutralization container receives the acid-treated crude oil and the second alkaline aqueous solution, produces the neutralized crude oil, and communicates the neutralized crude oil to a last neutralization container.

19. The system of claim 11 wherein the at least one separation container comprises more than one separation container arranged in series, wherein a first separation container receives the neutralized crude oil, produces a treated crude oil, and communicates the treated crude oil to a last separation container.

20. The system of claim 11 wherein at least one of the alkaline processing containers, the acid processing container, and the neutralization container comprises a metal ion generation system that comprises at least one perforated tube filled with one or more metals.

* * * * *